US007420114B1

(12) United States Patent
Vandervoort

(10) Patent No.: US 7,420,114 B1
(45) Date of Patent: Sep. 2, 2008

(54) METHOD FOR PRODUCING REAL-TIME RHYTHM GUITAR PERFORMANCE WITH KEYBOARD

(76) Inventor: Paul B. Vandervoort, 35 N. Edison Way, #10, Reno, NV (US) 89502-2351

( * ) Notice: Subject to any disclaimer, the term of this patent is extended or adjusted under 35 U.S.C. 154(b) by 591 days.

(21) Appl. No.: 11/150,695

(22) Filed: Jun. 11, 2005

Related U.S. Application Data

(60) Provisional application No. 60/579,417, filed on Jun. 14, 2004.

(51) Int. Cl.
*G10H 1/38* (2006.01)
*G10H 7/00* (2006.01)

(52) U.S. Cl. ..... 84/613; 84/609; 84/615; 84/649; 84/653

(58) Field of Classification Search ..... None
See application file for complete search history.

(56) References Cited

U.S. PATENT DOCUMENTS

| | | | | |
|---|---|---|---|---|
| 3,227,027 | A | 1/1966 | Von Gunten | |
| 3,358,070 | A | 12/1967 | Young | |
| 3,617,602 | A | 11/1971 | Kniepkamp | |
| 3,725,562 | A | 4/1973 | Munch, Jr. et al. | |
| 3,842,182 | A | 10/1974 | Bunger | |
| 3,967,520 | A | 7/1976 | Drydyk | |
| 4,154,131 | A | 5/1979 | Studer et al. | |
| 4,332,183 | A | 6/1982 | Deutsch | |
| 4,379,420 | A | 4/1983 | Deutsch | |
| 4,519,286 | A * | 5/1985 | Hall et al. | 84/613 |
| 5,136,914 | A | 8/1992 | Letts et al. | |
| 5,398,585 | A | 3/1995 | Starr | |
| 5,425,297 | A * | 6/1995 | Young, Jr. | 84/483.2 |
| 5,440,071 | A * | 8/1995 | Johnson | 84/637 |
| 5,544,562 | A * | 8/1996 | Jeon | 84/470 R |
| 5,726,374 | A | 3/1998 | Vandervoort | |
| 5,729,374 | A * | 3/1998 | Tiszauer et al. | 359/212 |
| 6,063,994 | A * | 5/2000 | Kew et al. | 84/600 |
| 6,448,486 | B1 * | 9/2002 | Shinsky | 84/613 |
| 6,657,115 | B1 | 12/2003 | Egorov et al. | |

* cited by examiner

*Primary Examiner*—Marlon T Fletcher

(57) ABSTRACT

A microprocessor-controlled data-processing system is used to process key strokes from a musical keyboard and output a series of note events (e.g., via midi) to a tone-producing device. The microprocessor runs software which splits the keyboard into at least two zones: A root-select zone which consists of at least one octave of keys, and a strum-trigger zone. Pre-determined notes lists, or chords, are stored in an array in the system's memory. The array classifies the note lists according to (1) chord root (C, C#, D, etc.), and (2) chord type (e.g., major, minor, etc.). Different keys within the strum-trigger zone are pre-assigned to different chord types. Depression of a strum-trigger key as a root-select key is depressed causes the data-processing system to (1) select one of the note lists, and (2) output an arpeggio of the notes contained within the selected list. The note list is selected from the array based on the root note corresponding with the depressed root-select key and the chord type corresponding with the depressed strum-trigger key. Hence, each strum-trigger key performs the dual function of chord type selection and strum triggering.

35 Claims, 19 Drawing Sheets

METHOD FOR PRODUCING REAL-TIME RHYTHM GUITAR PERFORMANCE WITH KEYBOARD

CROSS-REFERENCE TO RELATED APPLICATIONS

This application claims the benefit of provisional patent application Ser. No. 60/579,417, filed 2004 June 14 by the present inventor.

FIELD OF THE INVENTION

This invention relates to a keyboard-controlled electronic musical instrument capable of emulating a strumming guitar.

BACKGROUND OF THE INVENTION

When a guitarist plays a guitar with standard string tuning and the standard physical configuration (left hand selecting notes on the fretboard and right hand strumming the strings), a downstrum (in which the right hand strokes downward) generally produces an ascending arpeggiated chord. An upstrum generally produces a descending arpeggiated chord. Generally, a guitarist will alternate up and downstrums, producing arpeggiated chords which are alternately ascending and descending. This action is easy, smooth and natural, due to the fact that two chords may be produced with a single up-down cycle of the right hand. This two-chord-per-cycle technique enables a guitarist to easily produce strums in rapid succession. Also, this technique allows a guitarist to easily introduce a swing factor into the timing of the strums. A swing factor or "feel" is present when the elapsed time between an upstrum and a downstrum is different than the elapsed time between a downstrum and an upstrum. By consistently alternating strums with the same time difference, a guitarist can produce a desired swing feel. A guitarist may easily achieve this effect by simply displacing the center of his stroke either slightly above or slightly below the vertical center of the six strings (the vertical center of the strings is between the D and G strings). This displacement of stroke is so easy and natural that guitarists are often not even aware that they are doing it.

Various known prior art processing systems enable a keyboardist to simulate guitar strums. However, these prior art systems have been found to be lacking in the above stated advantageous qualities which a guitar possesses.

For example, U.S. Pat. No. 4,379,420 (Deutsch) describes a keyboard guitar emulator in which a group of keys perform the dual function of chord selection and arpeggiated chord triggering. In text column 11, lines 44-68, an alternating strum direction feature is disclosed. A musician, or user, may trigger a first strum by depressing a chord on the keyboard. Once the chord is depressed and held, an additional strum, alternating in direction, may be triggered by lifting any key within the chord and re-pressing it. Since a chord is triggered only when the key moves from rest to depressed position, the two-chord-per-cycle technique described above is not possible and the above described advantages of this technique are not realized.

Other guitar emulators provide a separate trigger switch to trigger arpeggiated chords, e.g., U.S. Pat. No. 3,967,520 (Drydyk), but none of the known prior art enables a user to produce arpeggiated chords in alternating directions with the same easy, smooth, and natural action of strumming a guitar.

GLOSSARY

Key:

An electronic triggering device which may be alternated between a rest state (typically "up" position) and a pressed state (typically "down", or "depressed" position) such as a key in a standard musical keyboard, an electronic Janko musical keyboard (e.g. as in U.S. Pat. No. 5,726,374), a standard computer keyboard, a foot-pedal board or any other array of push-button keys or switches. For the present invention, a keyboard may be worn on the user with the same orientation as the Z-Tar (manufactured by Starr Switch Co. of San Diego, Calif.), an accordion, or other strap-on keyboard, or a keyboard may be horizontally situated in the traditional fashion. The invention may also be realized through the use of two separate keyboards, one or both of which may be foot-pedal boards.

One or more keys may comprise a stationary metal plate which may be electrically connected to a finger sensing circuit. In this alternate embodiment, the triggering device comprises the metal plate key and the sensing circuit. The sensing circuit would occupy a rest key state (e.g., a low current state) when it is untouched and would occupy a selected key state (e.g., a relatively high current state) when a fingertip is making direct contact.

It should be noted that, for any type of key according to the present invention, the two trigger states are not transitory. They are distinct static states. A static state is to be distinguished from a transitory event in that a static state may be maintained indefinitely, and a transitory event may not. For example, the sweeping of a guitar pick over a set of guitar strings is an event. A keyboard key in rest position is in a static state. A key according to the present invention triggers an arpeggiated chord when it is shifted by the user from one static state to another. A key according to the present invention may be configured in such a manner that, under normal operating circumstances, the processing system is always informed of a shift from one state to the other.

Key state changes may be affected through movement of a human appendage, e.g., a finger, foot, elbow, palm, knee, or other body part. The speed with which this appendage moves may be measured in ways which are familiar to those of ordinary skill in the art. Information regarding the speed with which a human appendage effects a state change may be used to determine performance parameters, such as output velocity (e.g., midi velocity messages; normally used by a tone generating device to determine loudness) or arpeggiation rate.

Keyboard:

An array of keys as defined above.

Patch:

A software configuration of the system in which functions and/or chord types are assigned to keys, i.e., a "mapping" of the keyboard.

Tone-Generating Device:

An electronic and/or electrical machine which produces musical tones including (but not limited to) a standard midi sound module, a Steinberg VST-equipped computer system, a computer-controlled automatic piano, e.g., a PianoDisc® piano, or a computer-controlled automatic guitar, e.g., the "Crazy-J", developed at the George W. Woodruff School of Mechanical Engineering, Georgia Tech University, USA.

SUMMARY OF THE INVENTION

Overview:

According to the present invention, an electronic musical instrument is provided which includes at least fourteen keys contained within at least one keyboard. The electronic musical instrument also includes a digital data processing system, and a tone generating device.

The data processing system receives signals representing key state information from the keys, processes the information into musical event information (e.g., tone triggering/muting instructions) according to a predetermined software program, and transmits the musical event information to the tone generating device. The keyboard, processing system, and tone generating device may be housed within a single stand-alone unit, or separate units may be provided for each. For example, the invention may be realized through the use of a standard MIDI controller keyboard sending MDI data to a stand-alone computer which then processes the received data according to the invention and sends this processed data via MDI to a standard stand-alone electronic tone producing module. In the preferred embodiment, the keyboard and microprocessor-controlled processing system are housed in a single unit and communicate via MIDI and/or USB-midi to a tone-generating device. Alternately, the processing system and tone generating device may be incorporated into the same electronic device, circuit board, or even into the same microprocessor-driven computer system. Other hardware configurations are within the scope of the invention as well.

The software program divides the at least fourteen keys into at least two groups.

At least twelve keys are assigned to a root-select function. The system/software interprets these twelve root-select keys to each correspond with a different note of the twelve standard notes contained within an octave. The twelve root-select keys may be contiguous within the keyboard. The data processing system establishes the root-select function assignment by processing information about movement of these keys in a manner which is consistent with a root-select function. The tone generating device is capable of producing at least twelve different tones corresponding with the at least twelve root-select keys. The root-select keys are used to select the root note of the chord to be played. For example, if the desired chord is C major, then the musician presses the root-select key which corresponds with C. If a musical keyboard is used, then that key will be C. The data processing system may select a root-select key based on root-select keystrokes performed by the user. This selected key may then be stored in a data memory location. Alternately, the data processing system may scan the twelve root-select keys to select a pressed key when this data is needed. Since the musician may have no reason to simultaneously depress more than one root-select key at a time, the selected key generally corresponds with the last-pressed root-select key. However, a musician will sometimes accidentally strike two adjacent keys at once. Hence, as is discussed in the Performance Operating Software section below, the software may be engineered so that if a first root-select key is held in pressed state as a second root-select key is pressed, the selected root-select key is the second root-select key; and if either of the two pressed root-select keys are released as the other remains pressed, then the remaining pressed key is the selected root-select key. At least two methods may be used to achieve this result. In the first method, at least two root-select keys may be recorded as pressed in a list in data memory. When one is released, it is removed from the list and another pressed key, which remains in the list, is selected. This first note-determining method is used in the preferred embodiment described below. In a second method, all of the root-select keys are scanned immediately after a root-select key has been released. A key which remains down is then selected.

In addition to the root-select keys, at least two keys are assigned to a strum-trigger function. The data processing system establishes the strum-trigger function assignment by processing information about movement of these keys in a manner which is consistent with a strum-trigger function. The system/software interprets each of the at least two strum-trigger keys to correspond with a different chord type (e.g., major and minor). Each strum-trigger key performs the dual function of chord type selection and strum triggering. At least two strum-trigger keys are provided so that at least two different types of chords may be played. The data processing system transmits musical event information (e.g., midi note-on commands) representing a group of notes in response to a rest-to-pressed state change of a strum-trigger key. The group of notes comprises a musical chord. This chord is based, at least in part, on two factors: (1) the root note corresponding with a root-select key which has been pressed and thereby selected, and (2) the chord type corresponding with the pressed strum-trigger key.

At least two methods may be used to determine the notes within the chord.

In the first note-determining method, pre-determined note lists, or chords, may be stored in an array, or look-up table, in the processing system's memory (RAM 38 or ROM 39 as shown in FIG. 1). The array classifies the note lists according to (1) chord root (C, C#, D, etc.), and (2) chord type (e.g., major, minor, etc.). The appropriate note list may be retrieved when a strum-trigger key is pressed. This first note-determining method is used in the preferred embodiment described below. In a variation on this first note-determining method, the array may instead contain short number values, each of which may represent a specific chord. The proper code may be retrieved and transmitted to the tone generating device which may be capable of looking up and sounding the proper chord, perhaps in the form of a pre-recorded guitar strum sample. In this variation, the tone generating device may store a separate upstrum and downstrum sample for each chord in each key.

In a second note-determining method the processing system may call a chord-constructing subroutine when a strum-trigger key is pressed. This subroutine may calculate note lists according to a predetermined algorithm which may consider various predetermined factors such as common guitar chord voicings.

Other note-determining methods may be used alternately.

The invention may be realized through at least two methods which are described in the following two sections.

1. Single Trigger Keys Method:

With this method, when a strum-trigger key is pressed, the resultant chord comprises a group of notes which is transmitted in an ascending sequence. A pressed-to-rest state change of a strum-trigger key (e.g., an upstroke) causes the data processing system to perform a second transmission of musical event information representing a group of notes which is transmitted in a descending sequence. Hence, the musical results of strum-trigger key movements correspond with the movement of a guitar pick on a standard guitar. These transmissions are contingent upon at least one root-select key being held in pressed state as either of the strum-trigger key state changes occur. The data processing system transmits note-muting musical event information as a result of a pressed-to-rest state change (e.g., an upstroke) of the at least one pressed root-select key; i.e., strummed chords are muted by release of the root-select key.

2. Paired Trigger Keys Method:

With this second method, a strum-trigger key state change from pressed to rest state (i.e., a key release) does not initiate a chord or tone. Only state changes from rest to pressed state (e.g., downstrokes) cause the data processing system to initiate tone production. The data-processing system groups the strum-trigger keys into pairs, each pair consisting of an ASC (ascending) key and a DES (descending) key. A single chord type is assigned to each pair. Hence, at least four strum-trigger keys are required in order for a minimum of two different chord types (e.g., major and minor) to be played. The two keys within each pair operate interactively and are in close physical proximity to each other (not more than 166 mm apart) so that they may easily be played with two fingers within one hand. The data processing system transmits musical event information representing an ascending group of notes as a result of a rest-to-pressed state change of an ASC key, and transmits musical event information representing a descending group of notes as a result of a rest-to-pressed state change of a DES key. The keyboard may include at least two key rows, and the two keys within at least one of the strum-trigger key pairs may occupy different key rows.

If a sustain pedal is included in the system, then muting of sustaining tones may be contingent upon release of the sustain pedal.

BRIEF DESCRIPTION OF THE DRAWINGS

The drawing figures each show aspects of the presently preferred embodiment.

DESCRIPTION OF THE PREFERRED EMBODIMENT

I. Overview

Figure 1:
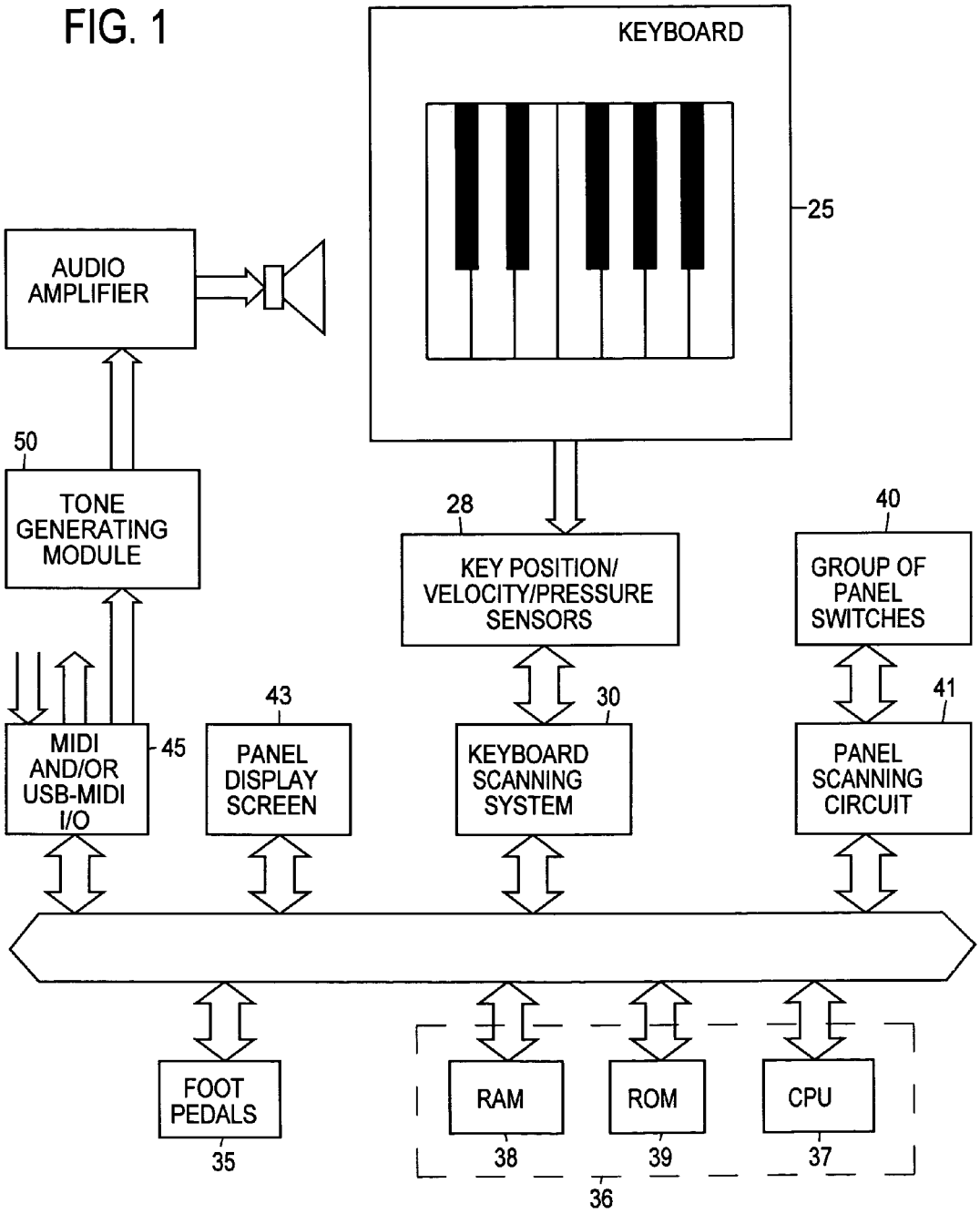
FIG. 1 shows a general overview of an electronic hardware system integrated with a keyboard which may be used to realize the invention.

The preferred embodiment of the invention is a midi/USB-midi controller keyboard unit incorporating the following features (See FIG. 1):

(1) a standard two-row (one white keys row and one black keys row) 61-note keyboard 25 which extends five octaves from a low C note to a high C note;

(2) a key state sensing system (including key position/velocity/pressure sensors 28 and a system to scan these sensors 30) which can, for each key of the keyboard 25, sense downward/upward velocity;

(3) two foot-switch pedals 35, consisting of a left-side select pedal and a right-side sustain pedal;

(4) a microprocessor-controlled computer system 36 (including a central processing unit 37, a random-access memory 38, and a read-only memory 39) which can process information received from the key state sensors and other input devices;

(5) a control panel including various switches 40 to perform various control duties (e.g., changing the operating mode of the unit and/or patches);

(6) a panel scanning circuit 41 for reading control panel key state information;

(7) a panel display screen 43 for displaying the current patch and other system data of interest to the user;

(8) at least one data input/output port 45 which can transmit processed information to a tone-producing module 50 via a standardized digital protocol such as MIDI, USB-MIDI, or both. This processed information includes note-on/velocity commands, note-off/velocity commands. A small microprocessor (not shown) may be provided, dedicated to the task of sending out MIDI data.

It is recommended that the sound module which receives midi data from the keyboard unit be of the type which can produce authentic audio reproductions of guitar string attacks, sustains, and string-muting sounds in response to corresponding midi commands, e.g., VSTi computer systems.

Figure 19:
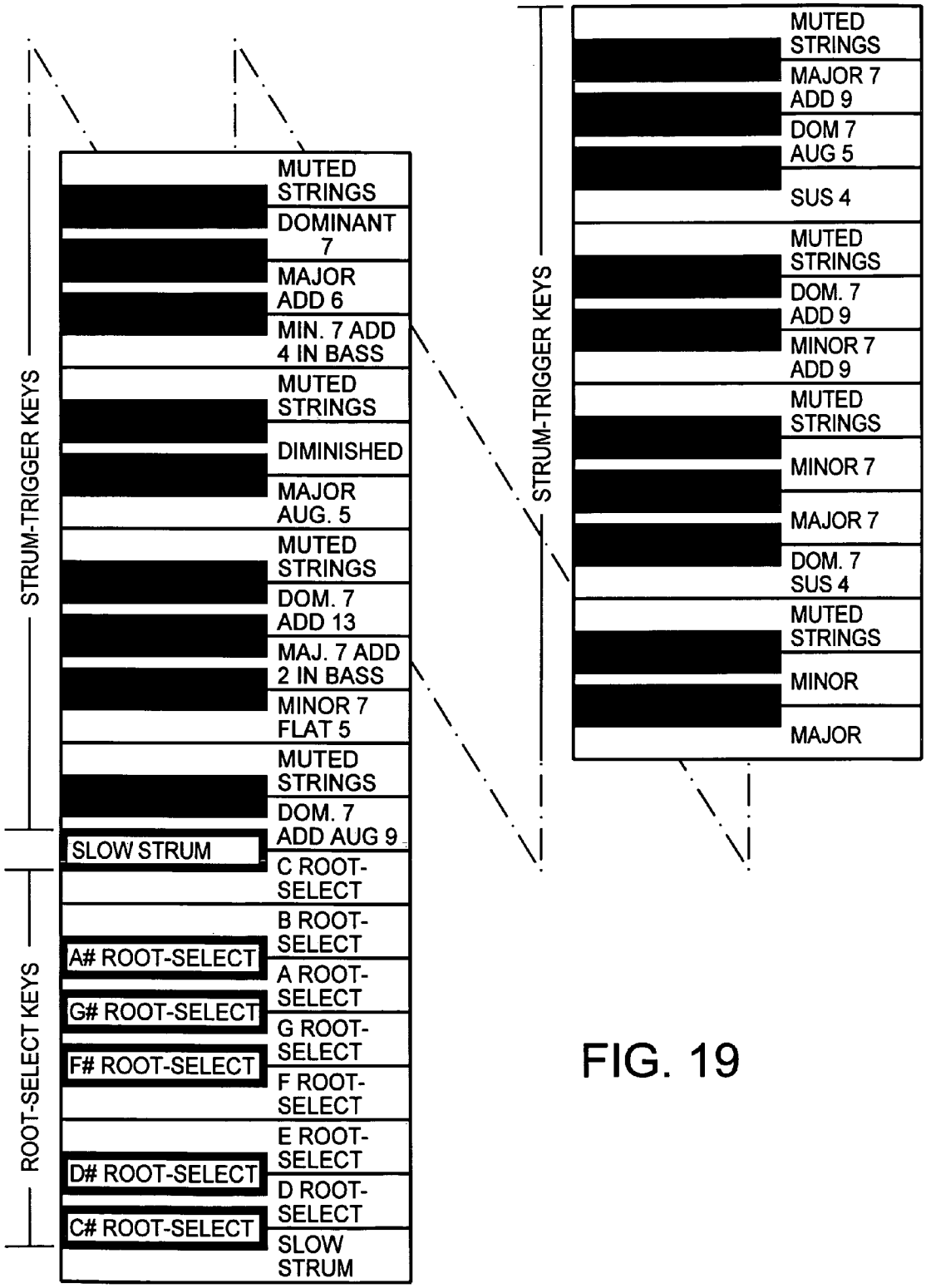
FIG. 19 shows a specific keyboard map according to the Paired Trigger Keys Method of the invention.

IIa. Summary of Features:

As shown in FIG. 19, the leftmost key (C) and the C# 13 keys to the right are assigned to a slow-strum mode select function. The 12 keys between the two slow-strum keys (C# thru C) are assigned to the root-select function. With this mapping, the user's left hand can simultaneously hold down a root-select key and a slow-strum key to execute a slow-speed strum (e.g. at the end of a song). The user may select between six different strum-trigger modes:

Single Trigger Keys Modes:

Mode 1:

Velocity (loudness) of individual notes determined by: Strum-trigger key velocity Strum rate determined by: Strum-trigger key velocity Mode 2:

Velocity of individual notes determined by: Strum-trigger key velocity

Strum rate determined by: Elapsed time between strum-trigger key downstrokes

Mode 3:

Velocity of individual notes determined by: Root-select key aftertouch pressure

Strum rate determined by: Strum-trigger key velocity

Paired Trigger Keys Modes:

Mode 4:

Velocity of individual notes determined by: Strum-trigger key velocity

Strum rate determined by: Strum-trigger key velocity

Mode 5:

Velocity of individual notes determined by: Strum-trigger key velocity

Strum rate determined by: Elapsed time between ASC key downstrokes

Mode 6:

Velocity of individual notes determined by: Root-select key aftertouch pressure

Strum rate determined by: Strum-trigger key velocity

An implementation of the present invention with any of Modes 4-6 is shown in FIG. 19. The C, D, F, G, & A strum-trigger keys are ASC keys. For each of these ASC keys, the corresponding DES key may be the black key adjacent on the right. Thus, for a given chord, a series of strums of alternating direction (ascending and descending) can be comfortably executed by alternating key depressions using the right thumb and index finger. Since a right thumb downstroke executes an ascending strum, this movement produces the same musical result as a downstrum on a standard guitar normally configured with standard tuning. An index finger downstroke corresponds with a standard guitar upstrum. The E and B strum-trigger keys trigger strums of muted strings. Thus, a series of muted string strums (e.g., a chucka-chucka sound) may be executed by alternating depressions of E & B keys located near each other.

For Modes 1, 2, 4, and 5, the musical event information (e.g. midi data) includes a loudness value (e.g., midi velocity messages). The keyboard measures a velocity with which strum-trigger keys are toggled between rest and pressed state (i.e., moved from either state to the other) and transmits this velocity data to the data processing system. The data processing system then assigns a loudness value to the musical tones which is proportional to the velocity data. Hence, faster strum-trigger keystrokes trigger louder musical tones.

For Modes 2 and 5, the data processing system transmits the group of notes (i.e., the musical chord) in a sequence (ascending or descending) with a delay period between successive notes. This delay period determines the strum rate, i.e., the rate at which the notes are sounded. The data processing system also measures an elapsed time between successive strum-trigger key state changes, and employs a predetermined algorithm which proportionally modulates the delay period according the elapsed time between key strokes. Hence, a shorter elapsed time between successive strum-trigger keystrokes will result in a shorter delay period between successive notes.

For Modes 3 and 6, the musical event information (e.g. midi data) includes a loudness value (e.g., midi velocity messages). The keyboard measures the pressure with which root-select keys are held in pressed state and transmits this aftertouch pressure data to the data processing system. (This raw aftertouch data may be monophonic keyboard aftertouch, or may be polyphonic. Polyphonic is preferred for this function because root-select key pressure may then be monitored independently of pressure applied to the keyboard by other keys.) The data processing system assigns a loudness value to the musical tones. This loudness value is proportional to the aftertouch pressure data. Hence, strum-trigger keystrokes trigger louder musical tones when root-select keys are held and pressed with more downward force.

For Modes 1, 3, 4, and 6, the data processing system transmits the group of notes (i.e., the musical chord) in a sequence (ascending or descending) with a delay period between successive notes. This delay period determines the strum rate, i.e., the rate at which the notes are sounded. The keyboard measures a velocity with which strum-trigger keys are toggled between rest and pressed state (i.e., moved from either state to the other) and transmits this velocity data to the data processing system. The data processing system then employs a predetermined algorithm which inversely modulates the delay period according the velocity. Hence, faster strum-trigger keystrokes will result in a shorter delay period between successive notes.

IIb. Relative Advantages of Modes:

An advantage of Modes 1, 2, & 3 is that only one key is required for each desired chord type. Hence, the number of different chord types which may be simultaneously available to the user is limited only by the number of strum-trigger keys.

Advantages of Modes 4, 5, & 6: Strums are easily and naturally triggered by downstrokes only; muting is easily accomplished by release of the depressed strum-trigger key; and consecutive strums of the same direction (e.g., downstrums) may be performed.

An advantage of Modes 1, 3, 4, & 6 over Modes 2 & 5 is that a wider span of strum note delays may be produced in real time, since modes 2 & 5 must set an arbitrary limit (e.g., 398 milliseconds) on measured strum delays (and, hence, on strum note delay values) to differentiate between successive strums & compositional pauses.

An advantage of Modes 1 & 4 is that they are easy to learn and master since both loudness and strum rate are controlled by downward keystroke velocity-a performance parameter which is easy and natural to control.

Advantages of Modes 2 & 6: The strum rate is calculated automatically; as though the user is strumming an actual guitar; and the loudness of the strummed notes can be modulated without affecting the strum rate (unlike Modes 1 & 4).

An advantage of Modes 3 & 6 is that loudness and strum rate may each be controlled directly and independently in real time without affecting any other parameters.

III. Performance Operating Software:

The software architecture may include a memory array containing predetermined note lists, i.e., chords stored in RAM 38 or ROM 39 (shown in FIG. 1). These note lists may be categorized according to (1) root note (C, C#, D, etc.), and (2) chord type (e.g., major, minor, etc.). For each list, the notes may be arranged in a sequence from highest-pitched to lowest-pitched. For descending strums, the notes may be read in sequence from first to last in the list, as seen in the DESCENDING STRUM ROUTINE flow chart (see FIG. 16A). For ascending strums, the notes may be read in sequence from last to first in the list, as seen in the ASCENDING STRUM ROUTINE flow chart (see FIG. 16B). A separate list may be provided for each combination of root note and chord type since different voicings are typically used by guitarists for different chords of the same type. For example, a guitarist may typically play E major in first position with open E strings two octaves apart; but a D major chord has A as the lowest string and F# as the highest. Some common guitar voicings include one or more muted strings, e.g., the low E string on a first-position D-major chord. Hence, some note lists may also include one or more muted strings so that each note list consists of six notes. Alternately, the software may be engineered so that different notes lists may contain different numbers of notes.

Following are some of the system's memory registers and their functions:

AFTREG: (7 bits) The current aftertouch pressure of the currently-depressed root-select key (may be measured from channel or poly aftertouch). This value may be scaled as discussed below.

CRNTCHRD: (# of bits depends on numerous factors, incl: # of stored chords & system architecture) The memory index number for the current chord (defined by root note and chord type).

CRNTVEL: (7 bits) The raw velocity (e.g., the initial midi velocity value) of the strum-trigger keystroke currently being processed (this initial value may be proportional to the speed with which the key was depressed.).

PREVCHRD: (# of bits depends on numerous factors, incl: # of stored chords & system architecture) The memory index number for the previous chord (defined by root note and chord type).

ROOTREG: (4 bits) The currently selected of twelve root notes (C, C# . . . B). The note stored in ROOTREG is used to select the root of a chord triggered with a strum-trigger key.

ROOTREGB: (4 bits) An auxiliary register used to record the identity of a recently depressed root-select key. In the event that a user's finger accidentally strikes two root-select keys simultaneously (e.g., G & A), ROOTREGB may be used to ensure that the key which remains depressed is the key which is used to select the root of the next strum chord.

RTKYSDWN: (4 bits) The number of root-select-keys in down position. This register may be set at zero during initialization and may be configured to never have a negative value. Hence, in the event that RTKYSDWN has a value of zero and a software step (e.g., step 260) subtracts 1, RTKYSDWN remains unchanged at zero. This situation is expected to occur only in the event that the user holds one or more root-select keys down during initialization.

SLOWSTRUM: (1 bit) When this bit is set, it indicates that one of the slow-strum keys is depressed. In this case, triggered strums may be executed with a predetermined strum delay of 127 milliseconds per note.

SNGLKEY: (1 bit) Set: Indicates that the previous strum was triggered by a single-trigger-key type (Mode 1, 2, or 3) strum-trigger key; Clear: Indicates that the previous strum was triggered by a double-trigger-key type (Mode 4, 5, or 6) strum-trigger key.

STKYSDWN: (# of bits depends on the maximum number of keys on the keyboard which may be assigned as strum-trigger keys; e.g., the total number of keys minus 12) The number of strum-trigger keys in down position. This register may be set at zero during initialization and may be configured to never have a negative value. Hence, in the event that STKYSDWN has a value of zero and a software step (e.g., step 301) subtracts 1, STKYSDWN may remain unchanged at zero. This situation is expected to occur only in the event that the user holds one or more strum-trigger keys down-during initialization.

STRMNOTEDLAY: (# of bits depends on desired resolution) The time delay between successive notes within a strum. For a maximum fast strum, STRMNOTEDLAY=0.8 bits are recommended, each unit representing 0.5 milliseconds; thereby allowing a maximum delay of 127 milliseconds per note. With this value, a maximum slow six-string strum takes 635 milliseconds—a very slow strum.

STRUMVEL: (7 bits) The velocity (e.g., the midi velocity value or loudness) of individual notes within a strum as transmitted from the keyboard unit to a sound module.

SUS_PED: (1 Bit) Set: Indicates that the sustain pedal is up; Clear: Indicates that the sustain pedal is down.

TIMER: (# of bits depends on desired resolution, but 6 is recommended) The time delay between successive ascending-chord-triggering strum-trigger key events. This register may be set up with a software or hardware timer to start with a value of zero, count up by one integer every 22.73 milliseconds, and automatically stop advancing at a predetermined maximum value of 35 after 796 milliseconds.

Figure 2:
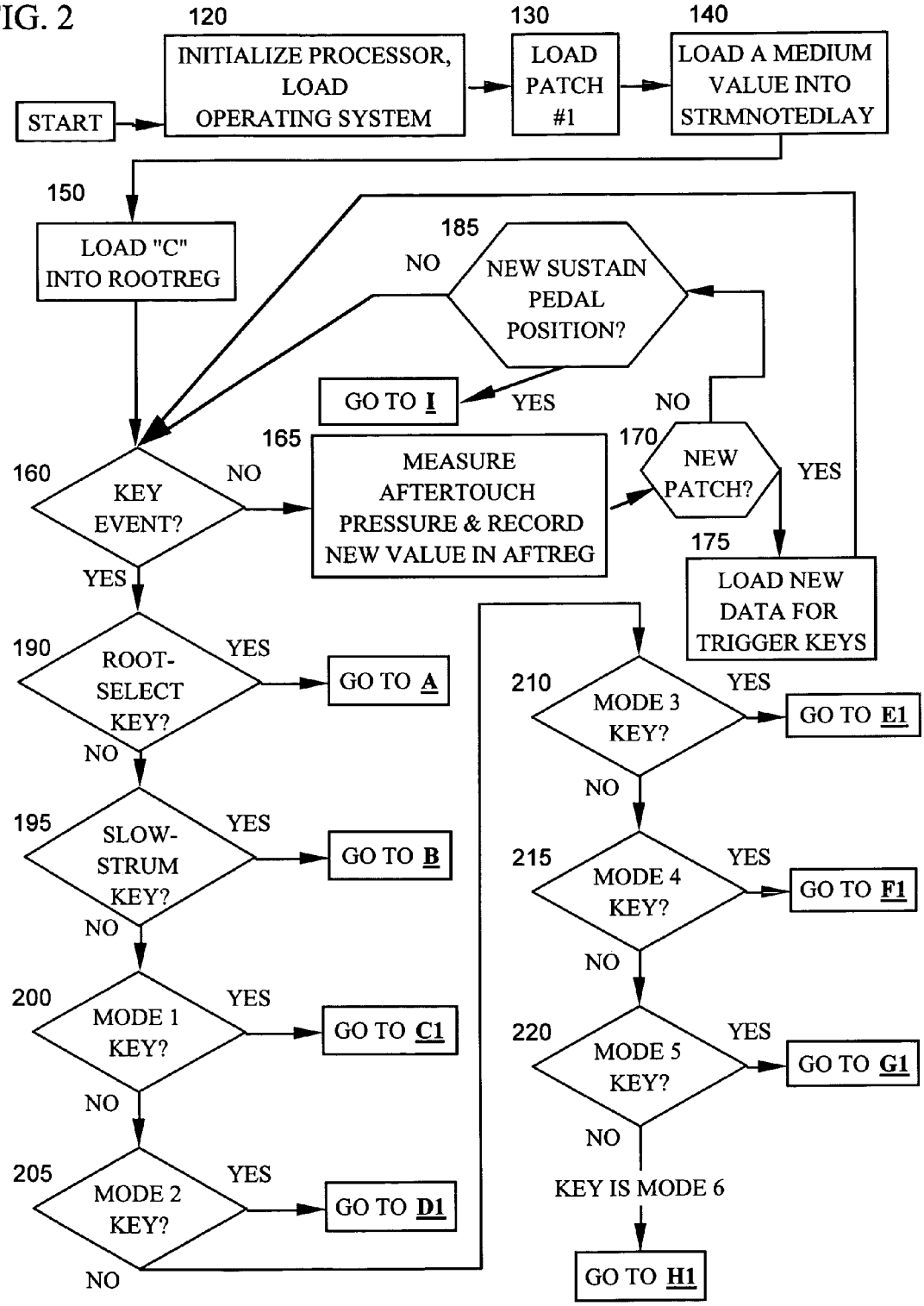
FIG. 2 shows an overview of the software program.

Software flow charts for the invention are shown beginning with FIG. 2.

In step 120, the processor may be initialized and the main keyboard operating system, or program, may be called.

In step 130, a patch may be loaded. This patch may define a configuration of key functions, e.g., the configuration shown in FIG. 19.

In step 140, a predetermined strum note delay value of 22 may be loaded into STRMNOTEDLAY. This value may correspond with the elapsed time between successive string (note) pluckings for a medium guitar strum hand speed. This value is loaded because the first trigger-key stroke of a Mode 2 or 5 key will have no previous key stroke from which to measure elapsed time. Hence a value must be loaded so that a first strum speed can be executed.

In step 150, C may be loaded as a root note so that an initial depression of a Mode 4-6 key will produce a strum of some type of C chord (e.g., C major).

In step 160, it may be determined whether a new key event has occurred. If not, aftertouch pressure may be measured and recorded in AFTREG in step 165. If the keyboard action used is only capable of measuring channel aftertouch, then the aftertouch for the entire keyboard may be measured. If the keyboard action can measure aftertouch of individual keys (poly-pressure), then only the pressure applied to the depressed root-select key is recorded in AFTREG. An algorithm may be employed to scale aftertouch data so that a minimum value greater than zero is always recorded in AFTREG. For example, while an aftertouch sensor may normally read a value of 0-127, this value may be scaled so that an input of 127 returns a 127 in AFTREG, while an input of 0 returns a 7, an input of 7 returns a 13, and so forth. Hence, if no root-select key is currently pressed, then the value in AFTREG will be 7. Thus, a Mode 3-6 strum-trigger key downstroke will always result in a sounded chord, regardless of whether any root-select keys are pressed.

In step 170, it may be determined whether the user has commanded a change of the chord type and/or Mode type of any strum-trigger keys by some state change of a control panel push-button switch or the left-side select pedal. If so, the new key-assignment data may be loaded in step 175. For example, depression of the left-side select pedal may call a second chord map (a second patch of the same Mode for the strum-trigger keys). Release of the pedal may return the keyboard to the first map. The chords in the second map may be chosen as common variations of the chords in the first map, e.g., an A key may trigger a dominant $7^{th}$ chord with the pedal up, and trigger a dominant $7^{th}$ sus. 4 with the pedal down. The control panel keys may also take the keyboard into a completely different mode, e.g., a conventional midi controller keyboard, or any of the various modes described in U.S. Pat. No. 5,726,374.

In step 185, it may be determined whether the user has moved the sustain pedal up or down.

In step 190, it may be determined whether the new key event is a state change of a root-select key.

In step 195, it may be determined whether the new key event is a state change of a slow-strum key.

In step 200, it may be determined whether the new key event is a state change of a Mode 1 strum-trigger key.

In step 205, it may be determined whether the new key event is a state change of a Mode 2 strum-trigger key.

In step 210, it may be determined whether the new key event is a state change of a Mode 3 strum-trigger key.

In step 215, it may be determined whether the new key event is a state change of a Mode 4 strum-trigger key.

In step 220, it may be determined whether the new key event is a state change of a Mode 5 strum-trigger key. If not, then the active key is a Mode 6 key by process of elimination.

Figure 3A:
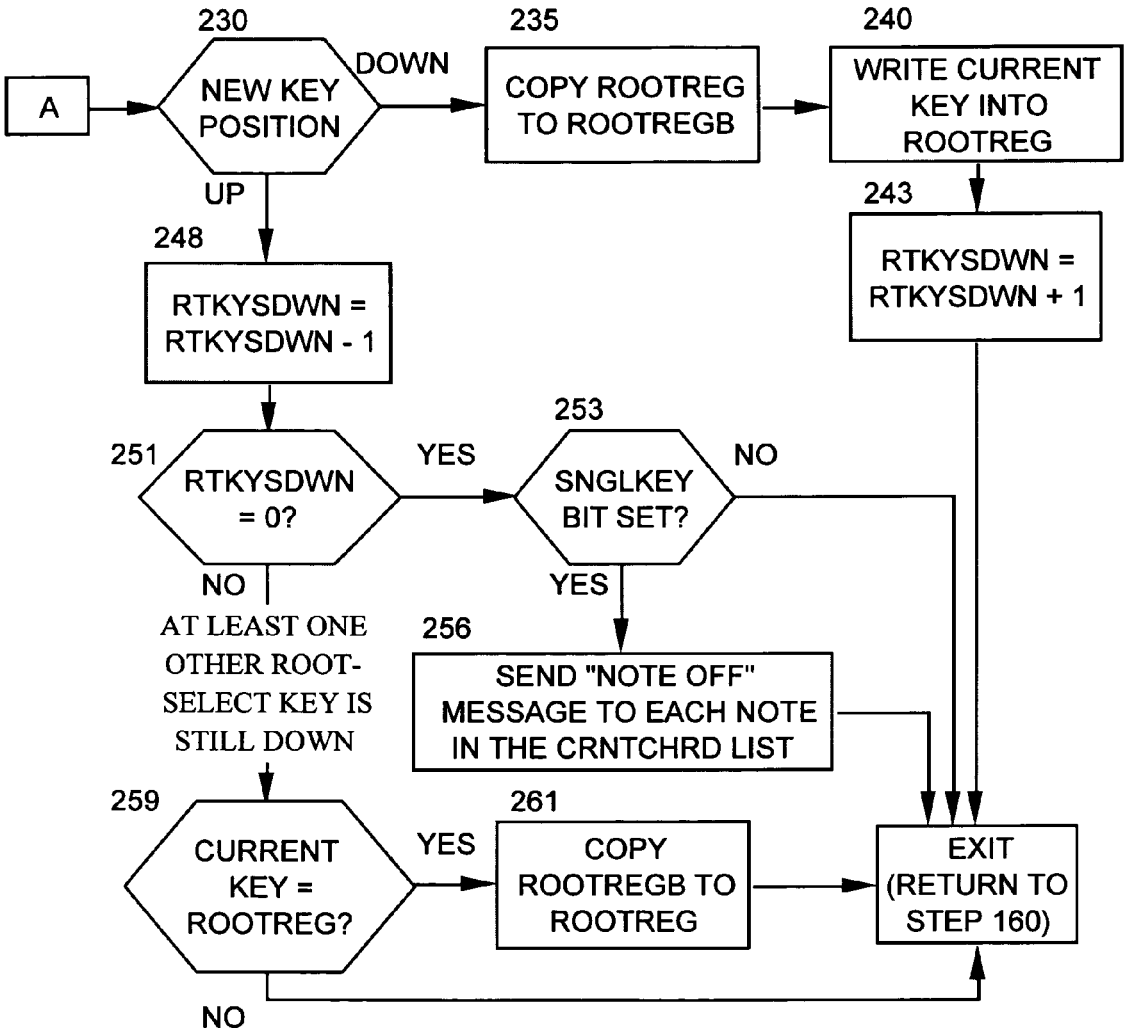
FIG. 3A shows the Root-Select Key Routine.

Referring to FIG. 3A, steps 230 thru 261 process root-select key state changes, i.e., keystrokes. In step 230 it is determined whether the current key has moved up or down. If down, then in step 235, the previously selected note (one of twelve) which is stored in ROOTREG may be copied into ROOTREGB. Then, in step 240 the note identity of the active key (i.e., the current key) may be written into ROOTREG. Thus, the note identity of the current key will be used to determine the root of any subsequent strum chord unless the value in ROOTREG is changed by another root-select key movement. In step 243 the value in RTKYSDWN may be increased by one to show the number of root-select keys currently depressed. If the new position of the current key is up, the value in RTKYSDWN may be decreased by one to show the number of root-select keys currently depressed in step 248. In step 251 it may be determined whether any root-select keys are down. If not, then it may be determined in step 253 whether a chord is currently sounding as a result of a movement of a Single Trigger Keys Mode strum-trigger key. If so, the notes of the chord may be muted in step 256. If at least one other root-select key is down, then the software may attempt to place the identity of the depressed key in ROOTREG in steps 259 and 261. In step 259 the identity of the current key may be compared with the value in ROOTREG. If they are not the same, then the current key is not the last root-select key which was depressed; and the subroutine may be exited. If the current key=ROOTREG, then a different key remains depressed. If no more than two root-select keys were depressed simultaneously, then the depressed key's identity will be recorded in ROOTREGB. This situation can easily occur if the musician, for example, presses A with his/her finger accidentally positioned slightly to the left. The side of the finger may depress G just far enough to record a key press. Since the side of the finger is depressing G, the A key press will occur before the G key press. The desired key will be A, but G will be the last-depressed key. In this case, A would be copied from ROOTREGB to ROOTREG in step 261.

Figure 3B:
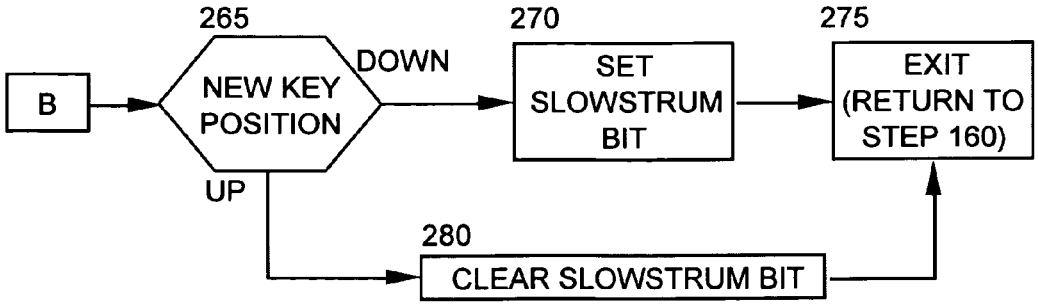
FIG. 3B shows the Slow-Strum Key Routine.

Referring to FIG. 3B, steps 265 thru 280 process slow-strum keystrokes. In step 265 it may be determined whether the new key position is down or up. If down, then the Slow-strum bit may be set in step 270. If up, then the Slowstrum bit may be cleared in step 280. In either case, the routine may be exited in step 275.

Figure 4:
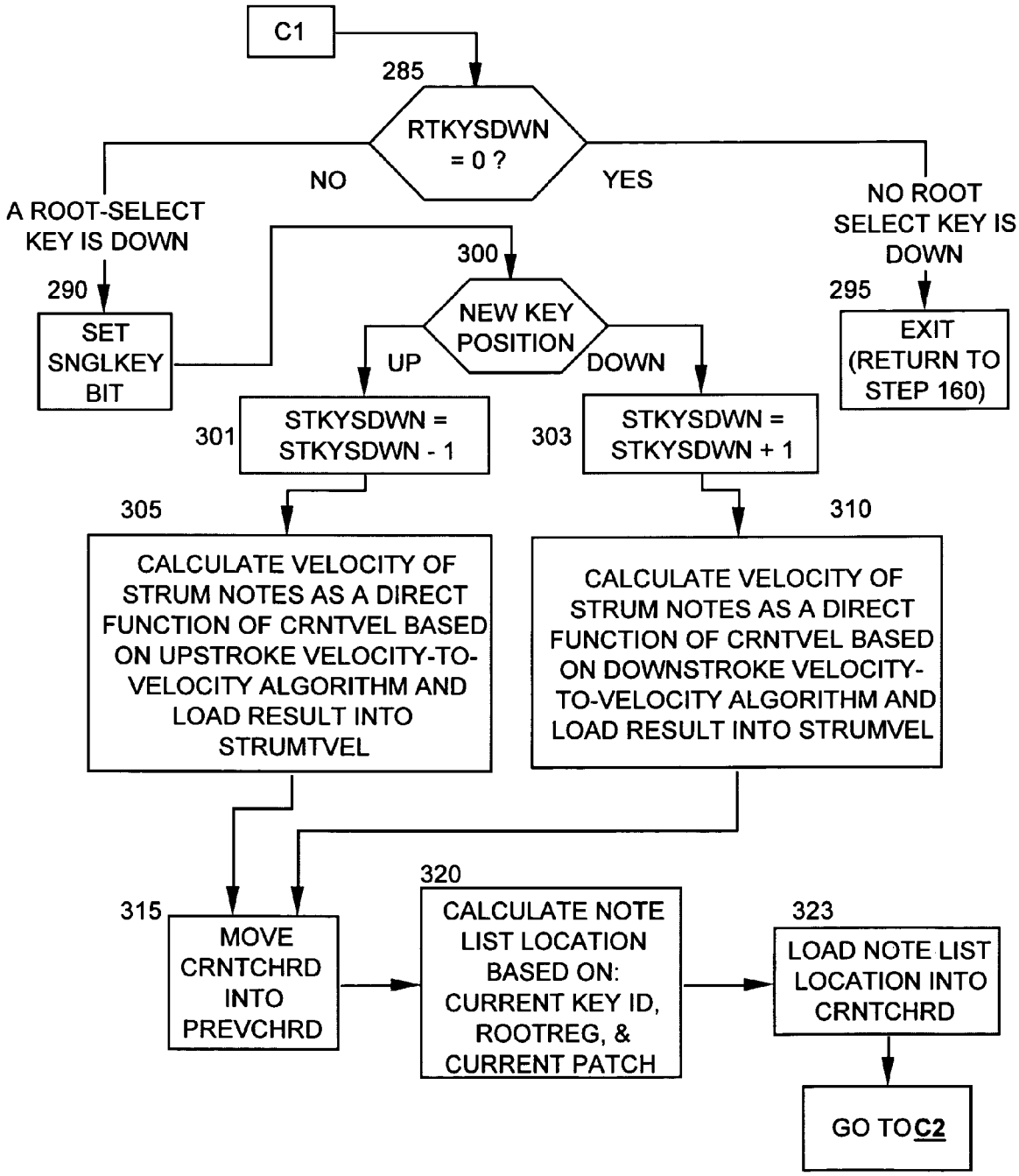
FIG. 4 shows the first half of the Mode 1 (Single Trigger Key) Routine.

Referring to FIG. 4, it may be determined in step 285 whether a root-select key is down. If not, the routine may be exited in step 295. Otherwise, the SNGLKEY bit may be set in step 290. In steps 300 thru 303, the new keystroke may be tabulated in the STKYSDWN register. This register may keep a running tally of the number of strum-trigger keys which are in down position. This information may be used in Modes 4 thru 6 to determine whether sustaining chords should be muted by release of the sustain pedal or release of a strum-trigger key. STKYSDWN serves no immediate function for Modes 1 thru 3, since muting in these modes may be accomplished by root-select key release. However the tally must always be maintained because the user may initiate a patch change while holding a key down. If, for example, a trigger key was held down as its function was changed from Mode 4 to Mode 1, and the Mode 1 routine did not register the key rise when it occurred, then the STKYSDWN tally would be incorrect. This incorrect data would then cause malfunction when Mode 4 is called again. In step 300 it may be determined whether the new key position is down or up. If up, the value in STKYSDWN may be decreased by one in step 301. If down, the value in STKYSDWN may be increased by one in step 303.

In steps 305 and 310, algorithms may be used to translate the input velocity of keystrokes as triggered by the user to velocity values for the individual notes (strings) within the strum to be sent (transmitted) to the sound module. The data-processing algorithms may consist of equations, look-up tables, or some combination, or the initial velocity value from the keyboard may simply be copied and attached to the strum notes (if this simple algorithm is found to produce satisfactory results) to produce a velocity-to-velocity response curve. It is recommended that two different velocity-to-velocity algorithms be used: An upstroke velocity-to-velocity algorithm called in step 305, and a downstroke velocity-to-velocity algorithm called in step 310. The velocity response curve for the upstroke algorithm may be pre-programmed with a higher gain than the downstroke response. For example, consider a key which physically moves from an up position to a down position. The velocity of this key movement may be measured by the duration of time the key spends in the middle ⅓ of its stroke. This measured value may be referred to as the key's "transit time". The two algorithms may be written so that a downstroke transit time of 16 milliseconds may produce a MIDI velocity value of 60, and an upstroke transit time of 16 ms might produce a MIDI velocity value of 100. The reason for this recommended higher gain for upstrokes is that a user will generally be able to move a key faster-on a downstroke than on an upstroke. Even if the key-scanning system is programmed to accommodate this difference, some tweaking of each response curve may be desired to achieve optimal results. In step 315, the value (a note list location in the memory array representing a musical chord) in PREVCHRD may be overwritten with the value in CRNTCHRD so that the value representing the memory array location of the previous strum chord may be found in PREVCHRD. In step 320, the memory array location of the new chord to be transmitted may be calculated. The value representing this new chord may then be written into CRNTCHRD in step 323.

Figure 5:
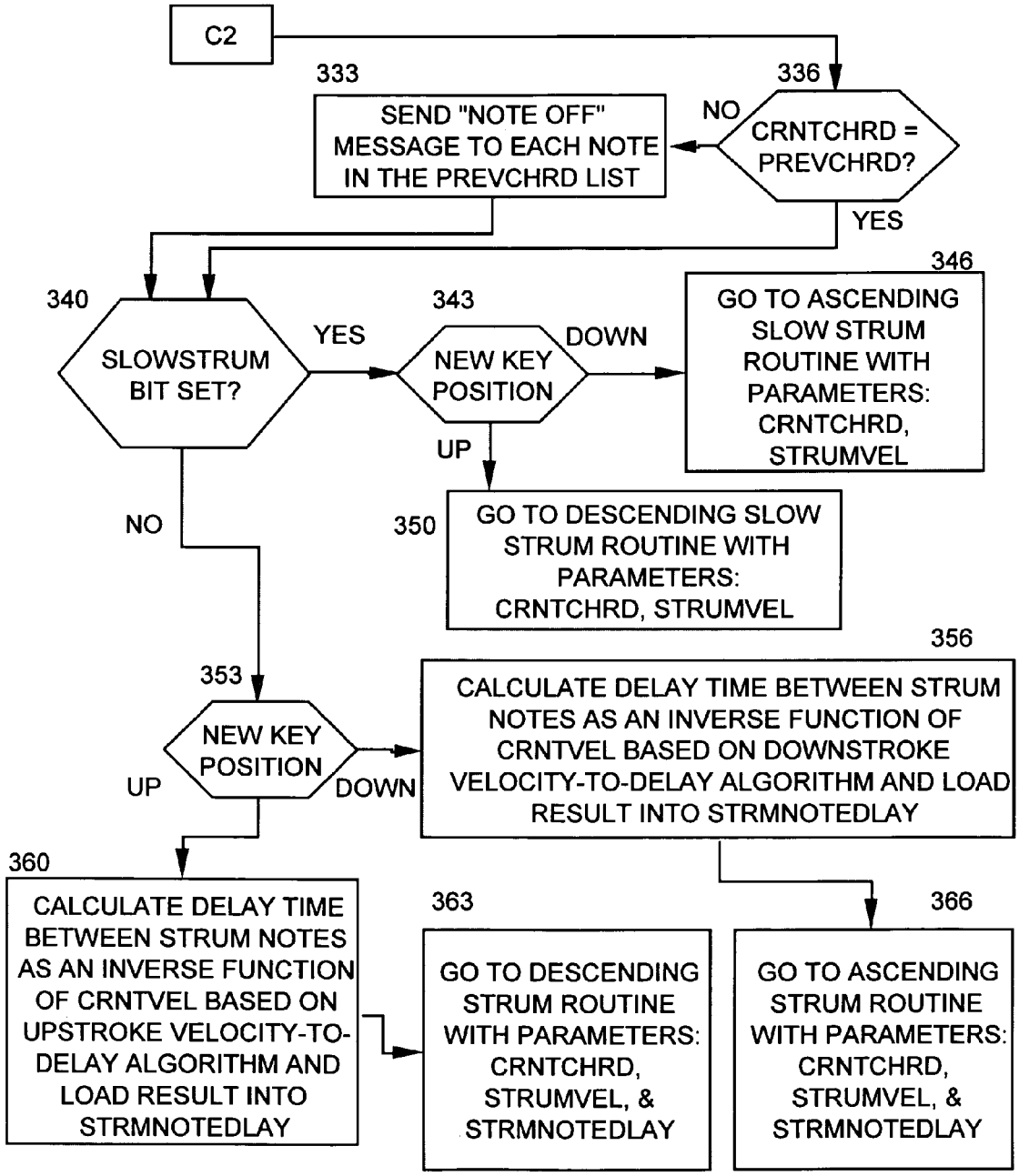
FIG. 5 shows the second half of the Mode 1 (Single Trigger Key) Routine.

Referring to FIG. 5, it may be determined in step 336 whether the last chord transmitted (PREVCHRD) is the same as the new chord (CRNTCHRD). If they are different, then all notes of the current chord may be muted in step 333. This step may be called when the chord has changed, either by a patch change, or depression of a different root-select/strum-trigger key. This function is to prevent hung notes as the new strum is executed and to provide a brief silent interval between strums of different chords. This silent interval serves to make the performance more like an actual rhythm guitar performance, since a guitarist can not instantly change from a sounding chord to a new one. In step 340 it may be determined whether the SLOWSTRUM bit is set, i.e., whether the musician wants the current strum to be slow or not. If so, then it may be determined in step 343 whether the new key position is up or down. If down, then the Ascending Slow Strum Routine may be called in step 346. This routine can be found in FIG. 17B. If up, then the Descending Slow Strum Routine may be called in step 350. This routine can be found in FIG. 17A. If the SLOWSTRUM bit is not set, then it may be determined in step 353 whether the new key position is up or down. In steps 356 and 360, algorithms may be used to translate the input velocity of keystrokes as triggered by the user to strum note delay values. The faster the user depresses the strum-trigger key, the faster the output strum. Hence, either algorithm will process a fast keystroke (with a high midi velocity value) into a short delay time between successive notes (strings) and vice versa. In other words, the delay time may be an inverse function of the keystroke's midi velocity value. The data-processing algorithms may consist of equations, look-up tables, or some combination to produce a velocity-to-delay response curve. It is recommended that two different velocity-to-delay algorithms be used: An upstroke velocity-to-delay algorithm called in step 360, and a downstroke velocity-to-delay algorithm called in step 356. The velocity response curve for the upstroke algorithm may be pre-programmed with a higher gain than the downstroke response. As with the velocity-to-velocity algorithms discussed above, different velocity-to-delay algorithms may be used for up and down strokes because a musician can naturally move a key at a faster rate of speed when depressing the key than when releasing it. Even if the key-scanning system is programmed to accommodate this difference, some tweaking of each response curve may be desired to achieve optimal results. The Ascending Strum Routine may be called in step 366. This routine can be found in FIG. 16B. The Descending Strum Routine may be called in step 363. This routine can be found in FIG. 16A.

Figure 6:
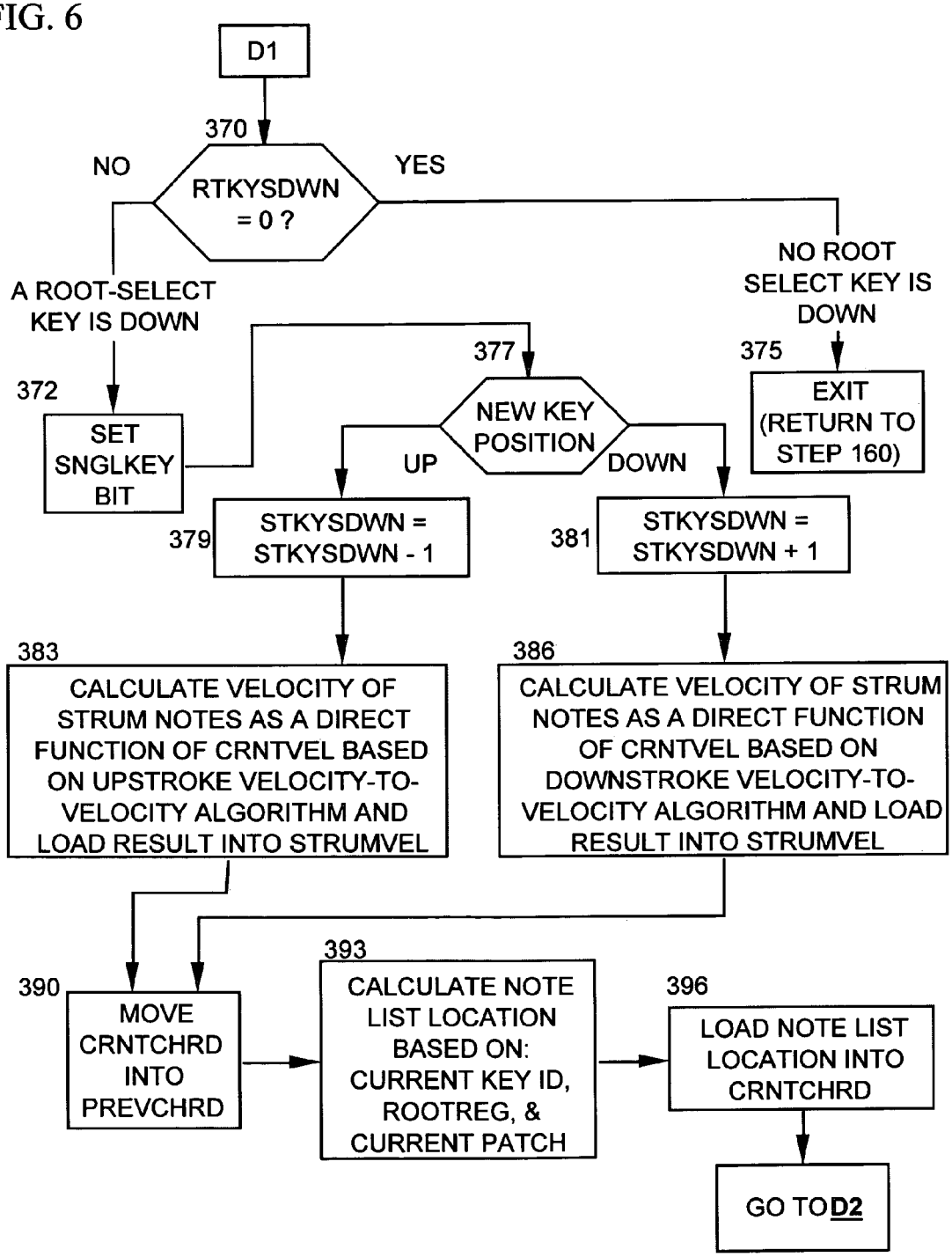
FIG. 6 shows the first half of the Mode 2 (Single Trigger Key) Routine.

Referring to FIG. 6, it may be determined in step 370 whether a root-select key is down. If not, the routine may be exited in step 375. Otherwise, the SNGLKEY bit may be set in step 372. In steps 377 thru 381, the new keystroke may be tabulated in the STKYSDWN register as discussed in reference to steps 300 thru 303 above. In step 377 it may be determined whether the new key position is down or up. If up, the value in STKYSDWN may be decreased by one in step 379. If down, the value in STKYSDWN may be increased by one in step 381. In steps 383 and 386, algorithms may be used to translate the input velocity of keystrokes to velocity values for the individual transmitted notes as discussed in reference to steps 305 and 310 above. In step 390, the value in PREVCHRD may be overwritten with the value in CRNTCHRD. In step 393, the memory array location of the new chord to be transmitted may be calculated. The value representing this new chord may then be written into CRNTCHRD in step 396.

Figure 7:
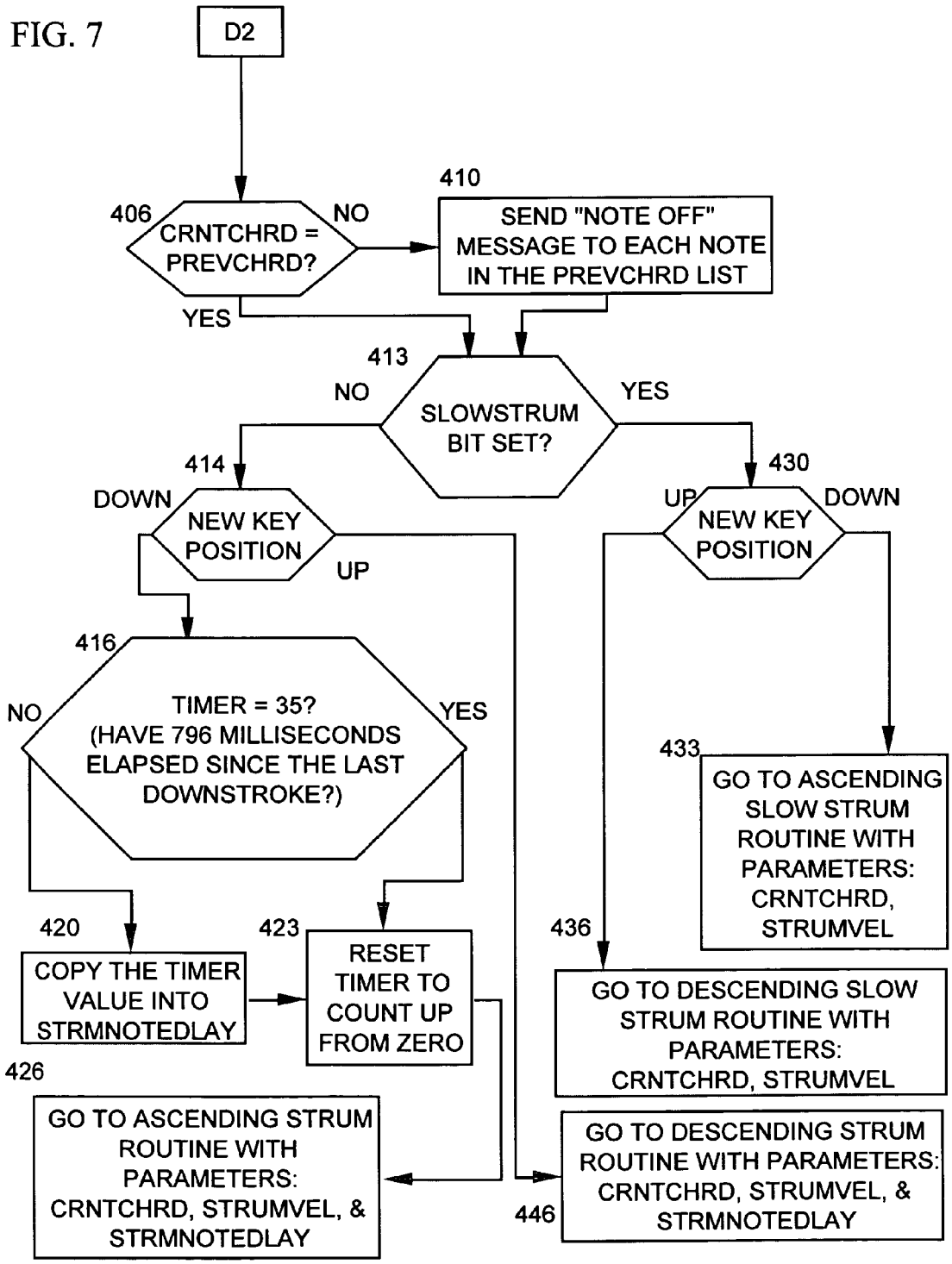
FIG. 7 shows the second half of the Mode 2 (Single Trigger Key) Routine.

Referring to FIG. 7, it may be determined in step 406 whether the last chord transmitted (PREVCHRD) is the same as the new chord (CRNTCHRD). If they are different, then all notes of the current chord may be muted in step 410 as discussed above in reference to step 333. In step 413 it may be determined whether the SLOWSTRUM bit is set. If so, then it may be determined in step 430 whether the new key position is up or down. If down, then the Ascending Slow Strum Routine may be called in step 433. This routine can be found in FIG. 17B. If up, then the Descending Slow Strum Routine may be called in step 436. This routine can be found in FIG. 17A. If the SLOWSTRUM bit is not set, then it may be determined in step 414 whether the current keystroke triggers an ascending strum (i.e., whether the current keystroke corresponds with a standard guitar downstrum). If so, the TIMER register, whose value began ascending with the previous ascending-strum keystroke, may be checked in step 416 to see whether 796 or more milliseconds have elapsed. Periods between successive ascending-strum keystrokes of 796 milliseconds or more may be regarded as compositional pauses, and not used to calculate strum rates.

In step 420 the value in TIMER may be loaded directly into STRMNOTEDLAY. This simple data transfer produces the desired result because of the 22.73 millisecond TIMER count-up period. Here is an explanation for how the 22.73 Ms period may be calculated: A guitar player, when strumming a string of chords (e.g., continuous eighth-notes), typically strums in an up-down oscillating pattern in which the elapsed time for a complete cycle (one downstroke and one upstroke) is between approx. 250 milliseconds and 800 milliseconds. During this cycle, the elapsed time during one strum from when the first string is plucked to when the sixth string is plucked is approx. 11% of the total cycle period. Since there are five delay periods between the six strings, the delay time between each adjacent string is 2.2% of the total period (11% divided by 5). For example, playing continuous eighth-notes during a song with a medium tempo of 120 quarter-notes per minute, the strum cycle period is 500 milliseconds; the elapsed time from first to last string pluck is 55 Ms (500 Ms×0.11) and the delay time between adjacent strings is 11 Ms (500 Ms×0.022). Since the value in STRMNOTEDLAY specifies the delay time between successive notes in 0.5 Ms increments, and the delay time between strings is 2.2% of the strum period, the TIMER period may be set at 22.73 Ms (0.5 Ms divided by 0.022) so that the value in TIMER can be directly loaded into STRMNOTEDLAY. Rather than measure elapsed time between ascending strums, the software could instead be written to measure the elapsed time between successive strums of opposite directions. This alternate method would have the advantage of measuring strum rate more quickly and updating the strum rate twice as often. However, this method is not advised because, as discussed above, guitar players often place a "swing feel" in their strum cycle. With a swing feel, the strings are not placed in the vertical center of the stroke and upstrums do not occur halfway in time between downstrums. Thus, the strum rate measurement between up & down strums would be different than between down and up strums during the same strumming pattern. Also, a swing feel pattern would have a different strum rate than an even-eighth-note pattern of the same tempo.

In step 423 TIMER may be reset to begin counting up from zero so that it may measure the time which will elapse between now and the next downstroke of a Mode 2 strum-trigger key or a Mode 5 ASC strum-trigger key. The Ascending Strum Routine may then be called in step 426. This routine can be found in FIG. 16B. If the new key position is determined to be up in step 414, the Descending Strum Routine may be called in step 446. This routine can be found in FIG. 16A.

Figure 8:
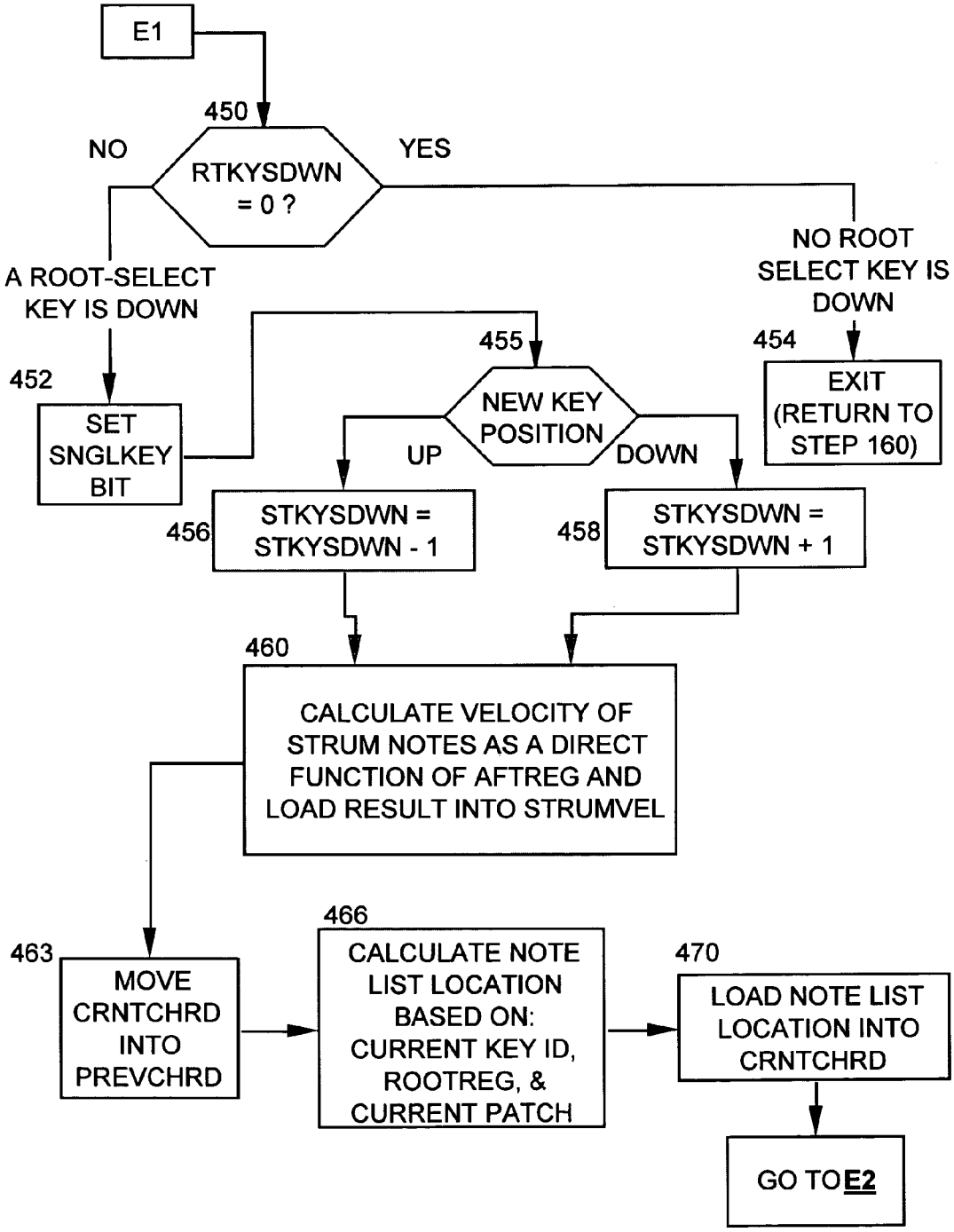
FIG. 8 shows the first half of the Mode 3 (Single Trigger Key) Routine.

Referring to FIG. 8, it may be determined in step 450 whether a root-select key is down. If not, the routine may be exited in step 454. Otherwise, the SNGLKEY bit may be set in step 452. In steps 455 thru 458, the new keystroke may be tabulated in the STKYSDWN register as discussed in reference to steps 300 thru 303 above. In step 455 it may be determined whether the new key position is down or up. If up, the value in STKYSDWN may be decreased by one in step 456. If down, the value in STKYSDWN may be increased by one in step 458. In step 460 a simple algorithm may be used to calculate the velocity value (e.g., loudness) of strum notes to be transmitted as a direct function of AFTREG (i.e., as a direct function of the pressure with which the musician is pressing the held-down root-select key). Also in this step, the result of this calculation may be loaded into STRUMVEL. In step 463, the value in PREVCHRD may be overwritten with the value in CRNTCHRD. In step 466, the memory array location of the new chord to be transmitted may be calculated. The value representing this new chord may then be written into CRNTCHRD in step 470.

Figure 9:
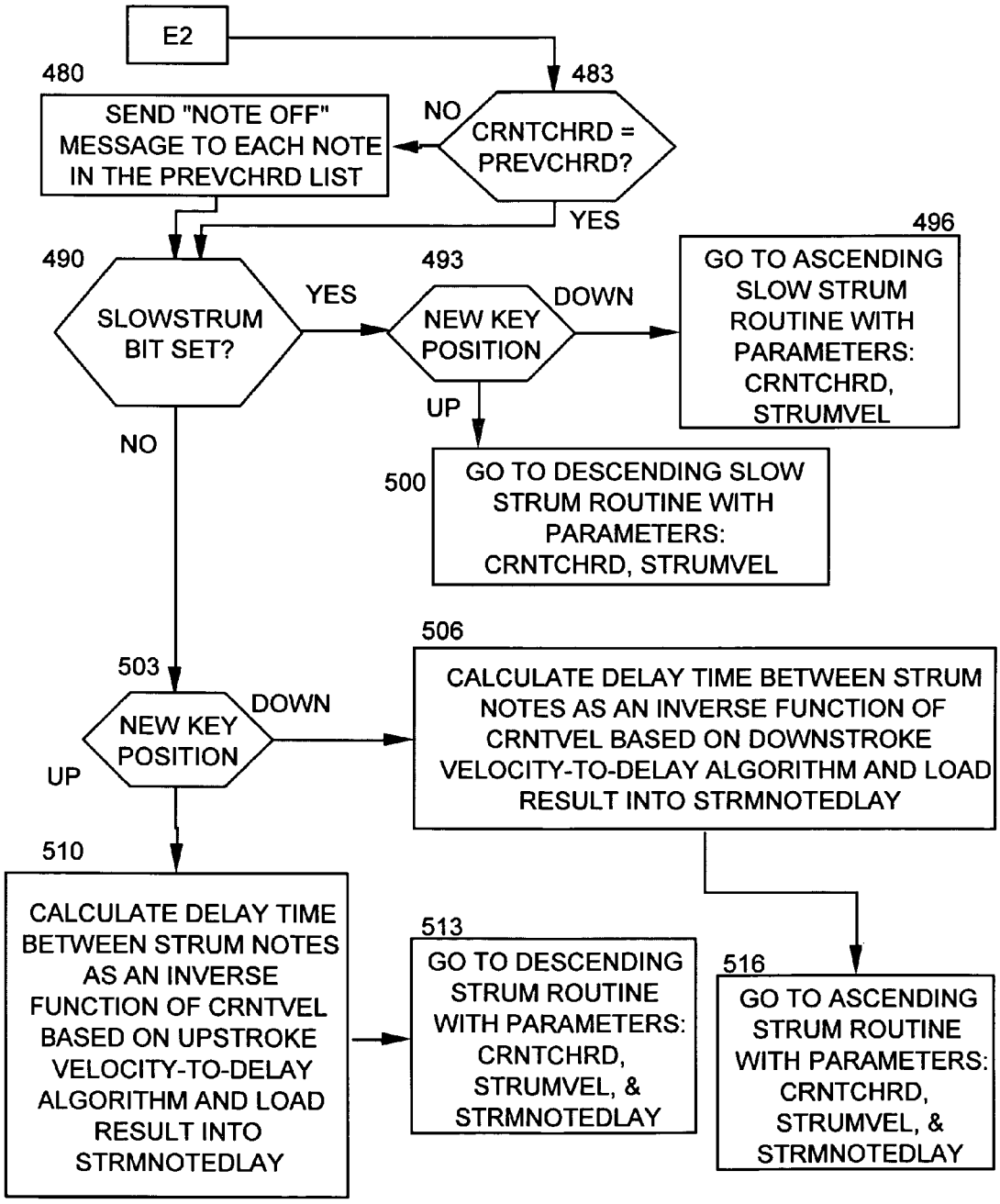
FIG. 9 shows the second half of the Mode 3 (Single Trigger Key) Routine.

Referring to FIG. 9, it may be determined in step 483 whether the last chord transmitted (PREVCHRD) is the same as the new chord (CRNTCHRD). If they are different, then all notes of the current chord may be muted in step 480 as discussed above in reference to step 333. In step 490 it may be determined whether the SLOWSTRUM bit is set. If so, then it may be determined in step 493 whether the new key position is up or down. If down, then the Ascending Slow Strum Routine may be called in step 496. This routine can be found in FIG. 17B. If up, then the Descending Slow Strum Routine may be called in step 500. This routine can be found in FIG. 17A. If the SLOWSTRUM bit is not set, then it may be determined in step 503 whether the new key position is up or down. In steps 506 and 510, algorithms may be used to translate the input velocity of keystrokes as triggered by the user to strum note delay values as discussed above in reference to steps 356 and 360. The Ascending Strum Routine may be called in step 516. This routine can be found in FIG. 16B. The Descending Strum Routine may be called in step 513. This routine can be found in FIG. 16A.

Figure 10:
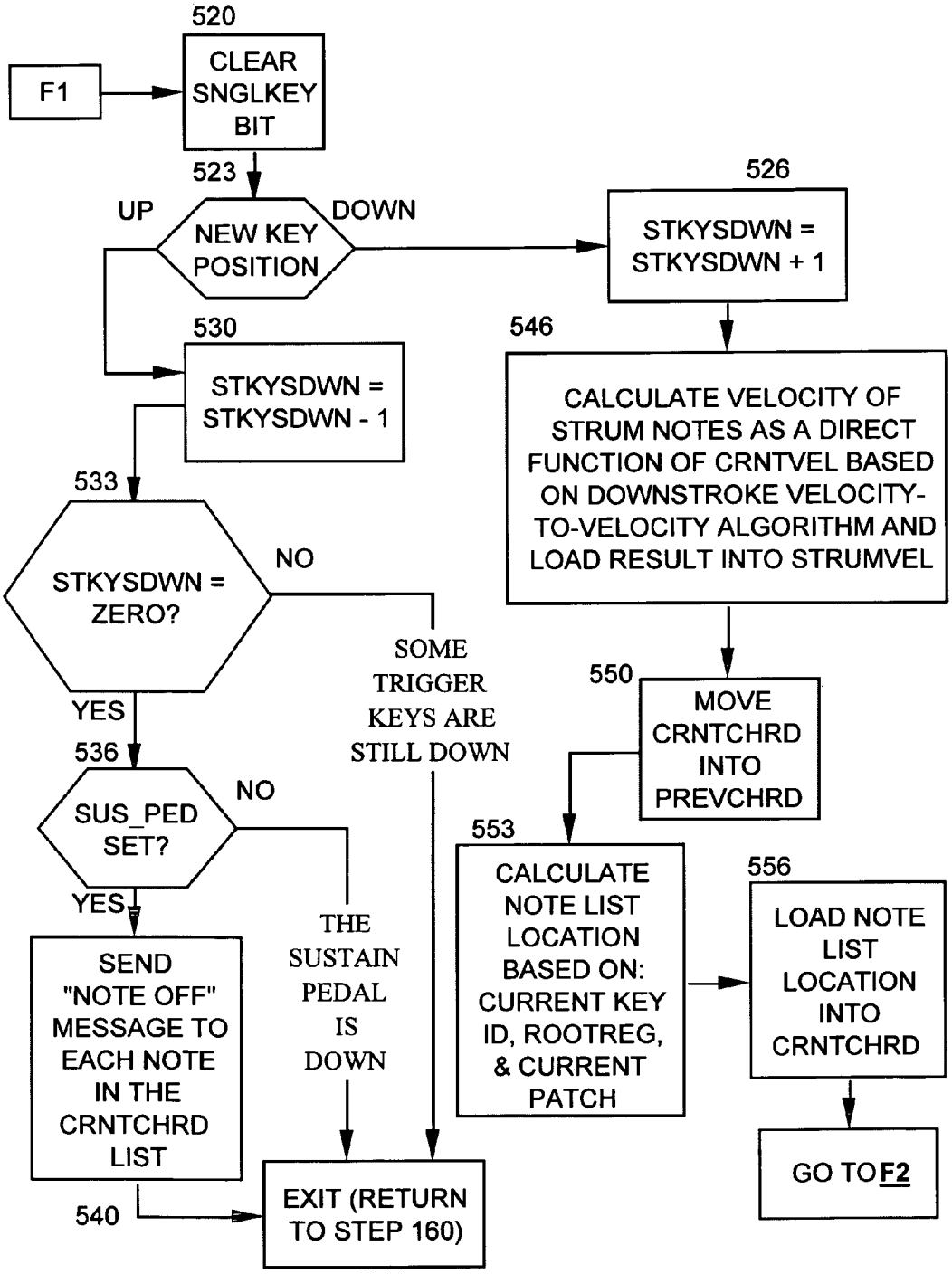
FIG. 10 shows the first half of the Mode 4 (Double Trigger Key) Routine.

Referring to FIG. 10, since this routine is for a double trigger key, the SNGLKEY bit may be cleared in step 520. In steps 523 thru 530 the new keystroke may be tabulated in the STKYSDWN register as discussed in reference to steps 300 thru 303 above. In step 523 it may be determined whether the new key position is down or up. If down, the value in STKYSDWN may be increased by one in step 526. If up, the value in STKYSDWN may be decreased by one in step 530 and STKYSDWN may be checked to see whether any strum-trigger keys are down in step 533. If no strum-trigger keys are down, then SUS_PED may be checked in step 536 to determine whether the sustain pedal is up. If so, all strummed notes which are sustaining may be muted in step 540. These steps may be duplicated in FIGS. 12 & 14 but not in the Single Trigger Key routines because in the Single Trigger Key modes, strum-trigger key movements never mute chords. If the new key position is determined to be down in step 523, then the downstroke velocity-to velocity algorithm may be used to translate the input velocity of keystrokes to velocity values for the individual transmitted notes in step 546 as discussed in reference to step 310 above. In step 550, the value in PREVCHRD may be overwritten with the value in CRNTCHRD. In step 553, the memory array location of the new chord to be transmitted may be calculated. The value representing this new chord may then be written into CRNTCHRD in step 556.

Figure 11:
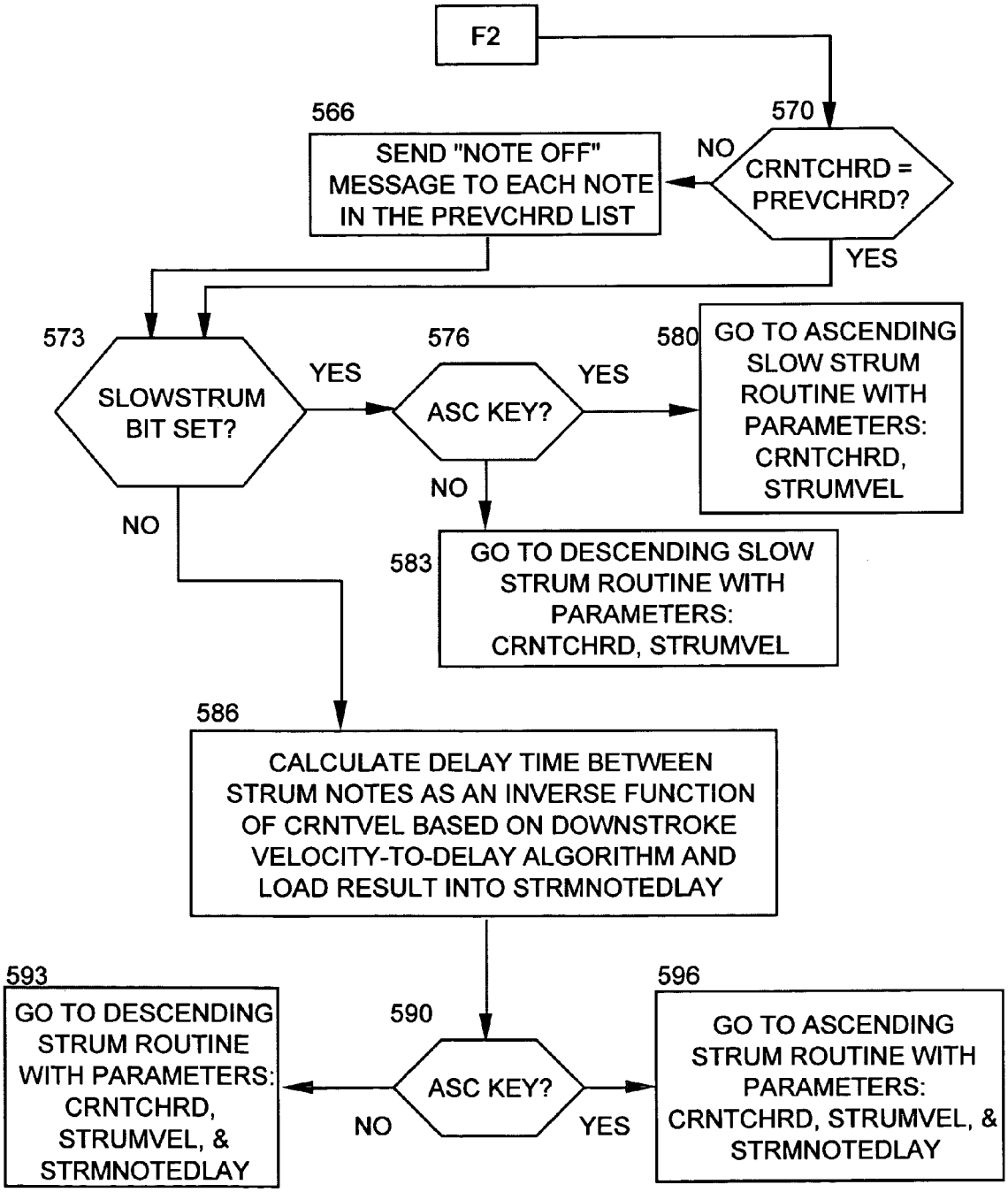
FIG. 11 shows the second half of the Mode 4 (Double Trigger Key) Routine.

Referring to FIG. 11, it may be determined in step 570 whether the last chord transmitted (PREVCHRD) is the same as the new chord (CRNTCHRD). If they are different, then all notes of the current chord may be muted in step 566 as discussed above in reference to step 333. In step 573 it may be determined whether the SLOWSTRUM bit is set. If so, then it may be determined in step 576 whether the current key is an ASC key. If so, then the Ascending Slow Strum Routine may be called in step 580. This routine can be found in FIG. 17B. If not, then the key is a DES key, in which case the Descending Slow Strum Routine may be called in step 583. This routine can be found in FIG. 17A. If the SLOWSTRUM bit is not set, then the downstroke velocity-to-velocity algorithm may be used in step 586 to translate the input velocity of keystrokes as triggered by the user to strum note delay values as discussed above in reference to step 356. In step 590 it may be determined whether the active key is an ASC key or a DES key. If the key is an ASC key, then the Ascending Strum Routine may be called in step 596. This routine can be found in FIG. 16B. Otherwise, the Descending Strum Routine may be called in step 593. This routine can be found in FIG. 16A.

Figure 12:
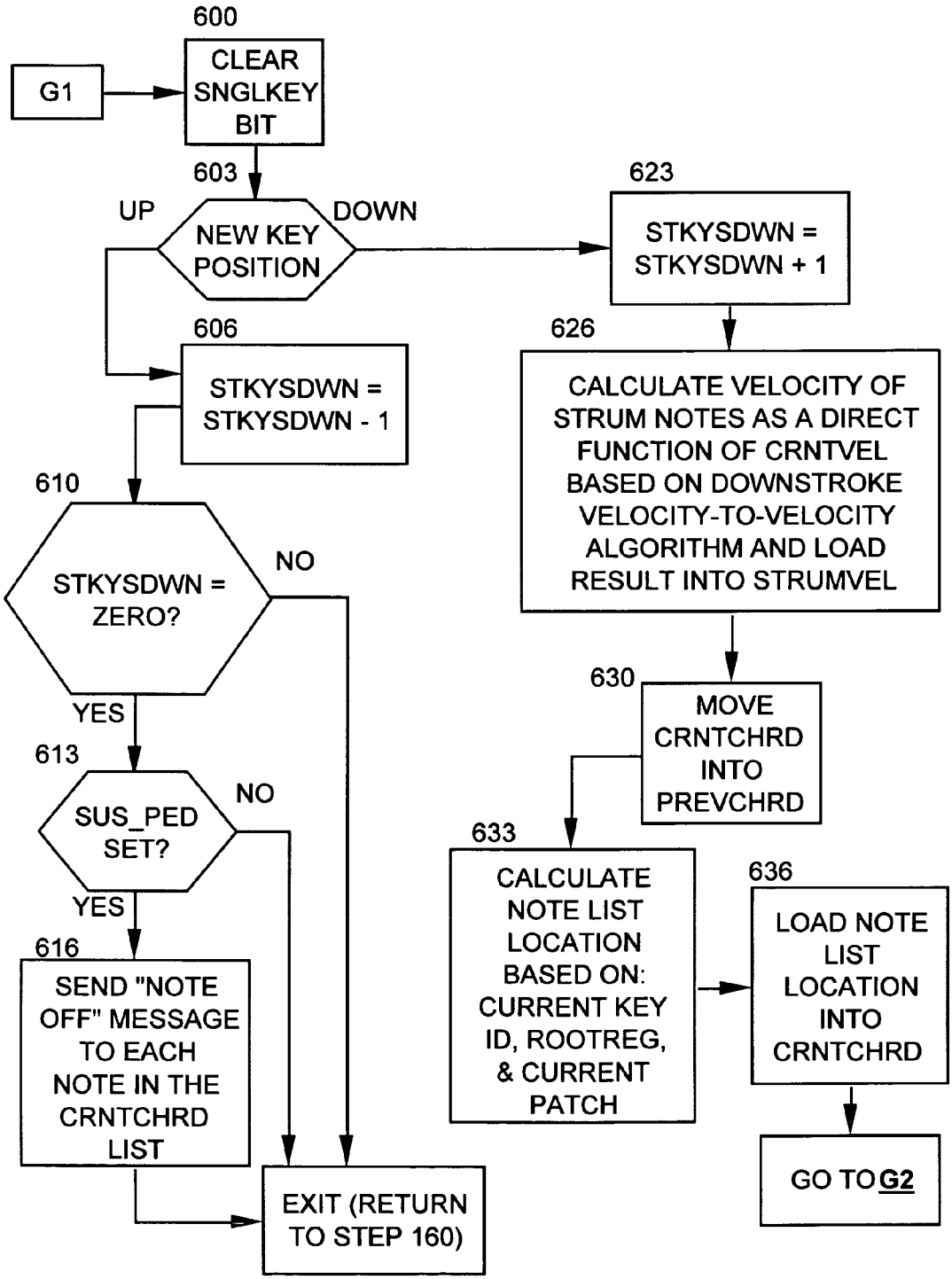
FIG. 12 shows the first half of the Mode 5 (Double Trigger Key) Routine.

Referring to FIG. 12, since this routine is for a double trigger key, the SNGLKEY bit may be cleared in step 600. In steps 603 thru 623 the new keystroke may be tabulated in the STKYSDWN register as discussed in reference to steps 300 thru 303 above. In step 603 it may be determined whether the new key position is down or up. If down, the value in STKYSDWN may be increased by one in step 623. If up, the value in STKYSDWN may be decreased by one in step 606 and STKYSDWN may be checked to see whether any strum-trigger keys are down in step 610. If no strum-trigger keys are down, then SUS_PED may be checked in step 613 to determine whether the sustain pedal is up. If so, all strummed notes which are sustaining may be muted in step 616. If the new key position is determined to be down in step 603, then the downstroke velocity-to-velocity algorithm may be used to translate the input velocity of keystrokes to velocity values for the individual transmitted notes in step 626 as discussed in reference to step 310 above. In step 630, the value in PREVCHRD may be overwritten with the value in CRNTCHRD. In step 633, the memory array location of the new chord to be transmitted may be calculated. The value representing this new chord may then be written into CRNTCHRD in step 636.

Figure 13:
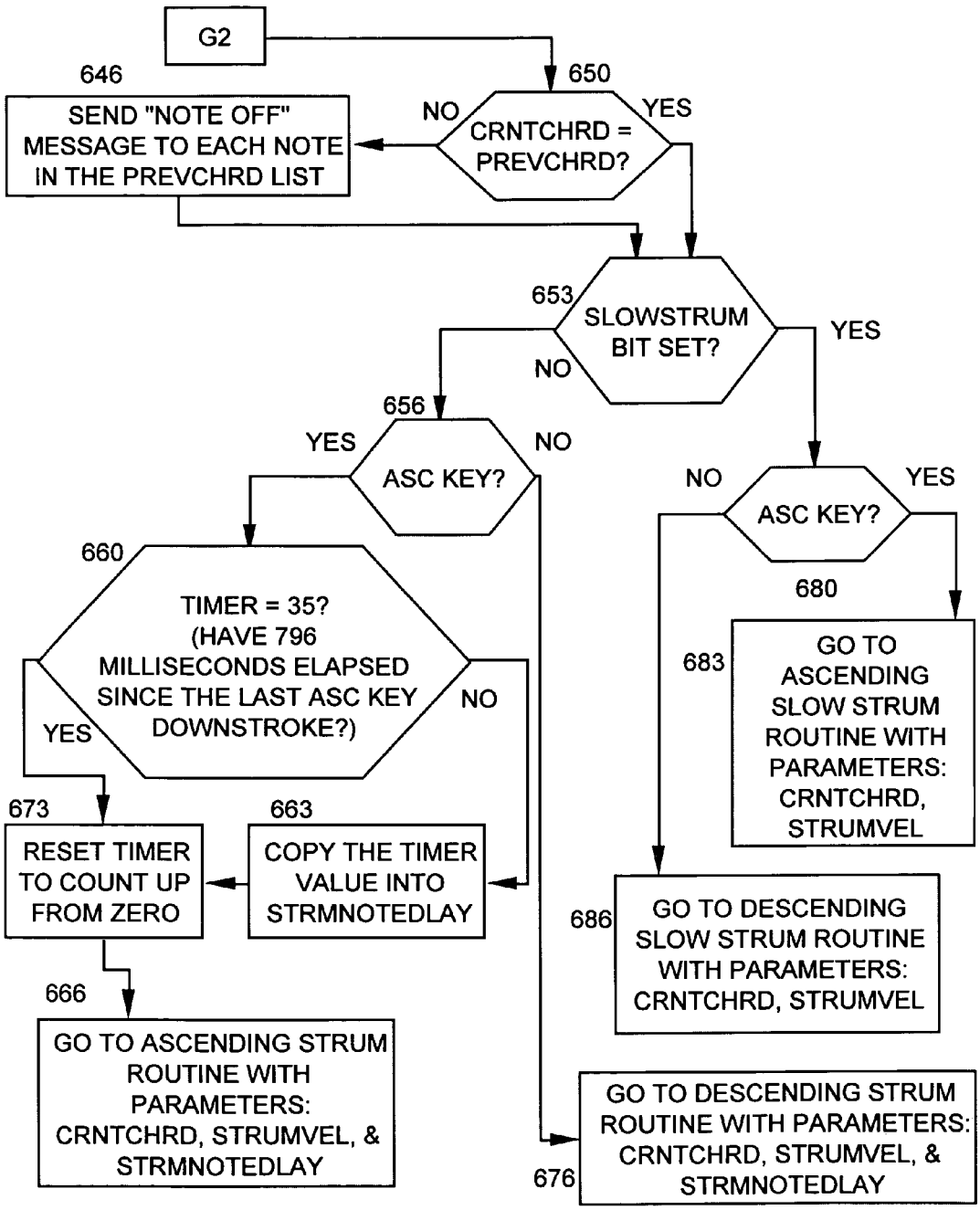
FIG. 13 shows the second half of the Mode 5 (Double Trigger Key) Routine.

Referring to FIG. 13, it may be determined in step 650 whether the last chord transmitted (PREVCHRD) is the same as the new chord (CRNTCHRD). If they are different, then all notes of the current chord may be muted in step 646 as discussed above in reference to step 333. In step 653 it may be determined whether the SLOWSTRUM bit is set. If so, then it may be determined in step 680 whether the current key is an ASC key. If so, then the Ascending Slow Strum Routine may be called in step 683. This routine can be found in FIG. 17B. If not, then the key is a DES key, in which case the Descending Slow Strum Routine may be called in step 686. This routine can be found in FIG. 17A. If the SLOWSTRUM bit is not set, then it may be determined in step 656 whether the current key is an ASC key, (i.e., whether the current keystroke corresponds with a standard guitar downstrum). If so, the TIMER register, whose value began ascending with the previous ascending-strum keystroke, may be checked in step 660 to see whether 796 or more milliseconds have elapsed. Periods between successive ascending-strum keystrokes of 796 milliseconds or more may be regarded as compositional pauses, and not used to calculate strum rates. In step 663 the value in TIMER may be loaded directly into STRMNOTEDLAY as discussed above in reference to step 420. In step 673 TIMER may be reset to begin counting up from zero so that it may measure the time which will elapse between now and the next downstroke of a Mode 2 strum-trigger key or a Mode 5 ASC strum-trigger key. The Ascending Strum Routine may then be called in step 666. This routine can be found in FIG. 16B. If it is determined in step 656 that the current key is a DES key, then the Descending Strum Routine may be called in step 676. This routine can be found in FIG. 16A.

Figure 14:
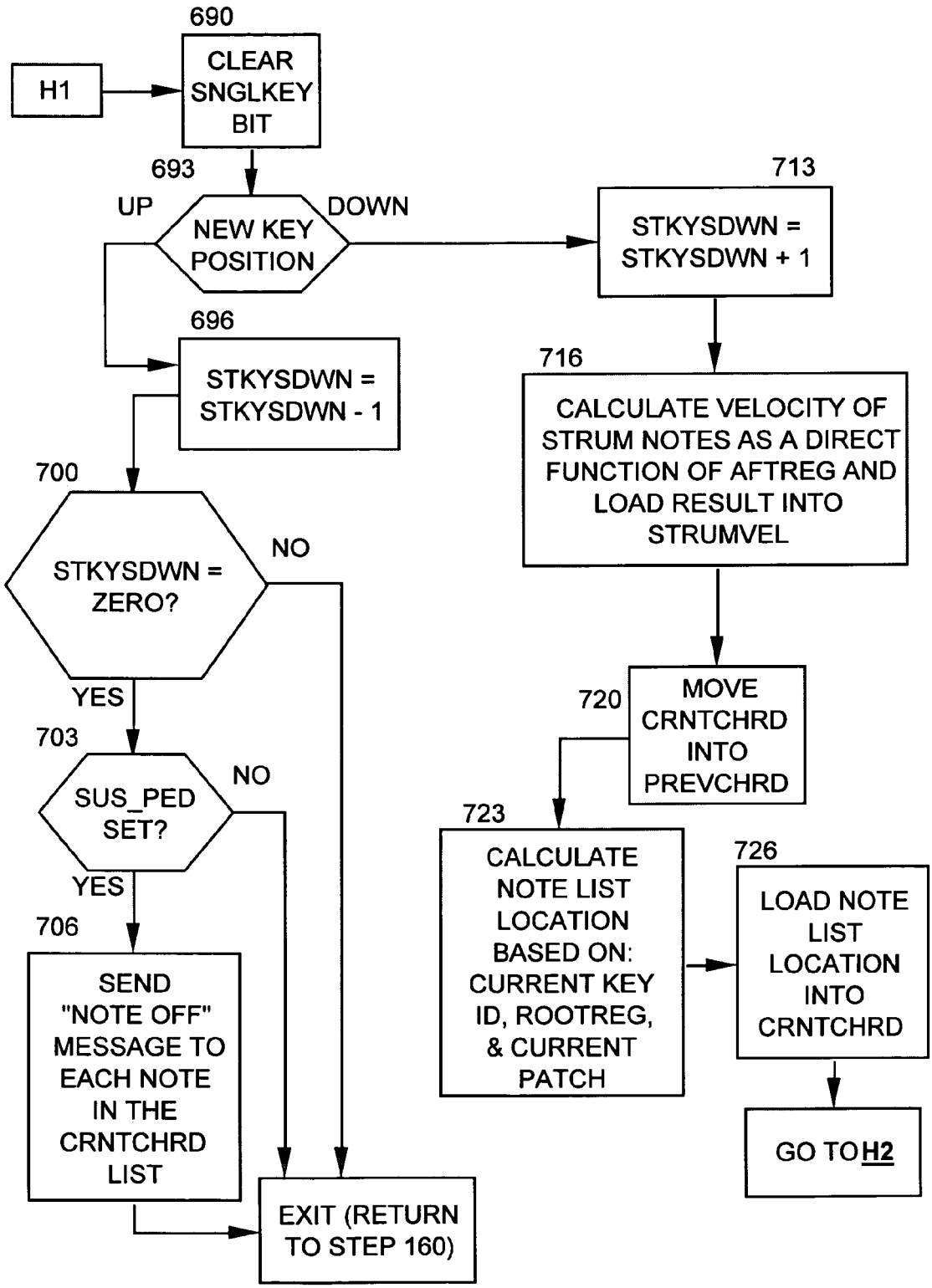
FIG. 14 shows the first half of the Mode 6 (Double Trigger Key) Routine.

Referring to FIG. 14, since this routine is for a double trigger key, the SNGLKEY bit may be cleared in step 690. In steps 693 thru 713 the new keystroke may be tabulated in the STKYSDWN register as discussed in reference to steps 300 thru 303 above. In step 693 it may be determined whether the new key position is down or up. If down, the value in STKYSDWN may be increased by one in step 713. If up, the value in STKYSDWN may be decreased by one in step 696 and STKYSDWN may be checked to see whether any strum-trigger keys are down in step 700. If no strum-trigger keys are down, then SUS_PED may be checked in step 703 to determine whether the sustain pedal is up. If so, all strummed notes which are sustaining may be muted in step 706. If the new key position is determined to be down in step 693, a simple algorithm may be used in step 716 to calculate the velocity value (e.g., loudness) of strum notes to be transmitted as a direct function of AFTREG (i.e., as a direct function of the pressure with which the musician is pressing the held-down root-select key). Also in this step, the result of this calculation may be loaded into STRUMVEL. In step 720, the value in PREVCHRD may be overwritten with the value in CRNTCHRD. In step 723, the memory array location of the new chord to be transmitted may be calculated. The value representing this new chord may then be written into CRNTCHRD in step 726.

Figure 15:
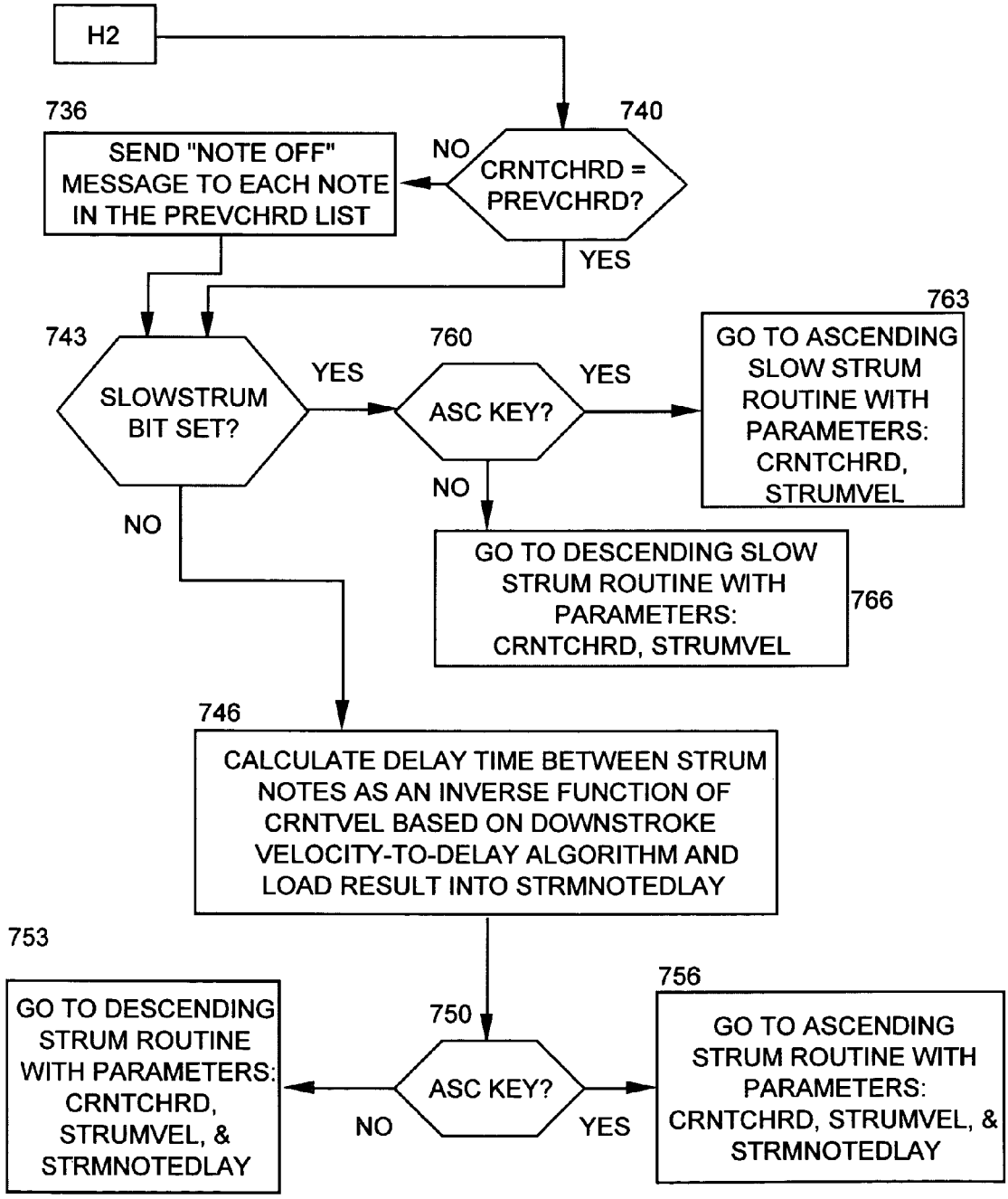
FIG. 15 shows the second half of the Mode 6 (Double Trigger Key) Routine.

Referring to FIG. 15, it may be determined in step 740 whether the last chord transmitted (PREVCHRD) is the same as the new chord (CRNTCHRD). If they are different, then all notes of the current chord may be muted in step 736 as discussed above in reference to step 333. In step 743 it may be determined whether the SLOWSTRUM bit is set. If so, then it may be determined in step 760 whether the current key is an ASC key. If so, then the Ascending Slow Strum Routine may be called in step 763. This routine can be found in FIG. 17B. If not, then the key is a DES key, in which case the Descending Slow Strum Routine may be called in step 766. This routine can be found in FIG. 17A. If the SLOWSTRUM bit is not set, then the downstroke velocity-to-velocity algorithm may be used in step 746 to translate the input velocity of keystrokes as triggered by the user to strum note delay values as discussed above in reference to step 356. In step 750 it may be determined whether the active key is an ASC key or a DES key. If the key is an ASC key, then the Ascending Strum Routine may be called in step 756. This routine can be found in FIG. 16B. Otherwise, the Descending Strum Routine may be called in step 753. This routine can be found in FIG. 16A.

Figure 16A:
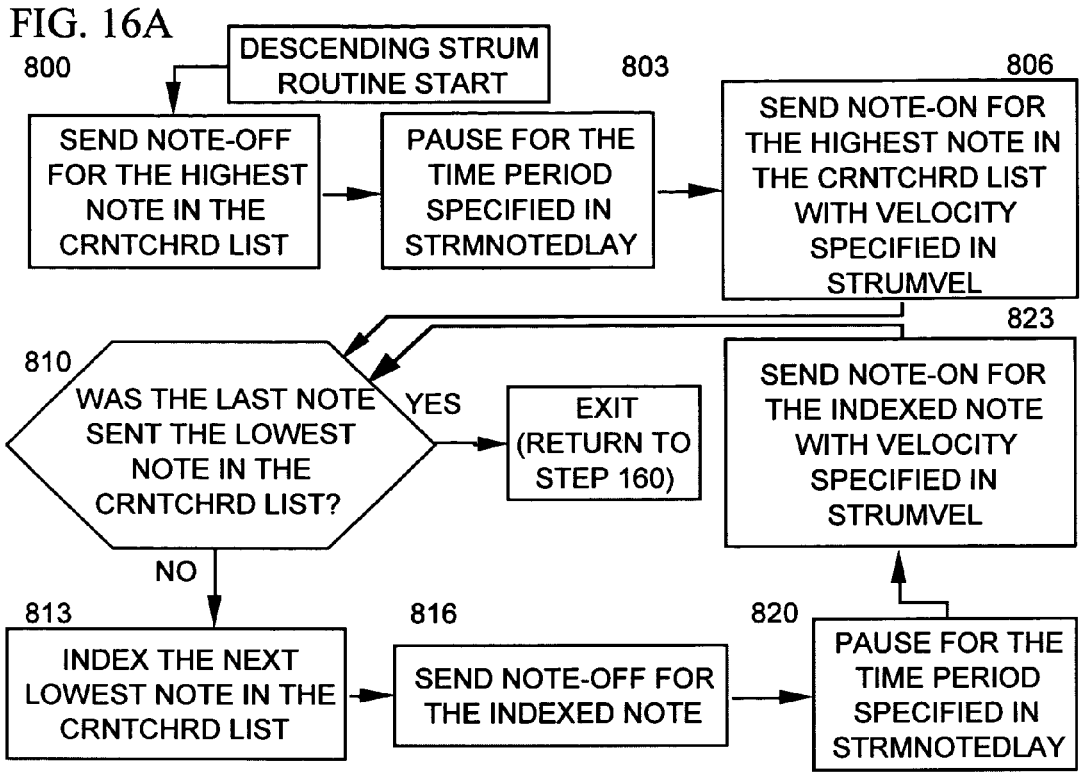
FIG. 16A shows the Descending Strum Routine.

Referring to FIG. 16A, a note-off command (e.g., a midi note-off command) may be transmitted to the tone-generating device in step 800 for the highest-pitched note in the CRNTCHRD list. This first position in the CRNTCHRD list may be indexed in a "scratchpad" data memory register. In step 803, the data-processing system may wait for a period of time equal to the value in STRMNOTEDLAY multiplied by 0.5 milliseconds to place a pause between successive notes within a strum. In step 806 a note-on command may be sent for the note which was muted in step 800. The purpose of the pause in step 803 (as well as those in steps 820, 836, and 853) is to (1) set the time delay between successive notes within the chord and to (2) provide increased temporal definition to the audio experience of the initial note-on attack. Without this pause between soundings of the same note, a listener will be more likely to experience an uninterrupted tone. When a pick strums a guitar string, it first mutes the string before plucking it. The software pause approximates this muting effect.

In step 810 it may be determined whether the note transmitted in step 806 or 823 was the lowest-pitched note in the CRNTCHRD list. If not, the value in the scratchpad may be incremented to index the next lowest note in step 813. In step 816, a note-off command may be sent for this newly-indexed note. In step 820 a pause may be inserted as in step 803. Then, in step 823, a note-on command may be sent for the note which was muted in step 816. When it is determined in step 810 that all notes of the chord have been sounded, the strum is finished and the routine may be exited.

Figure 16B:
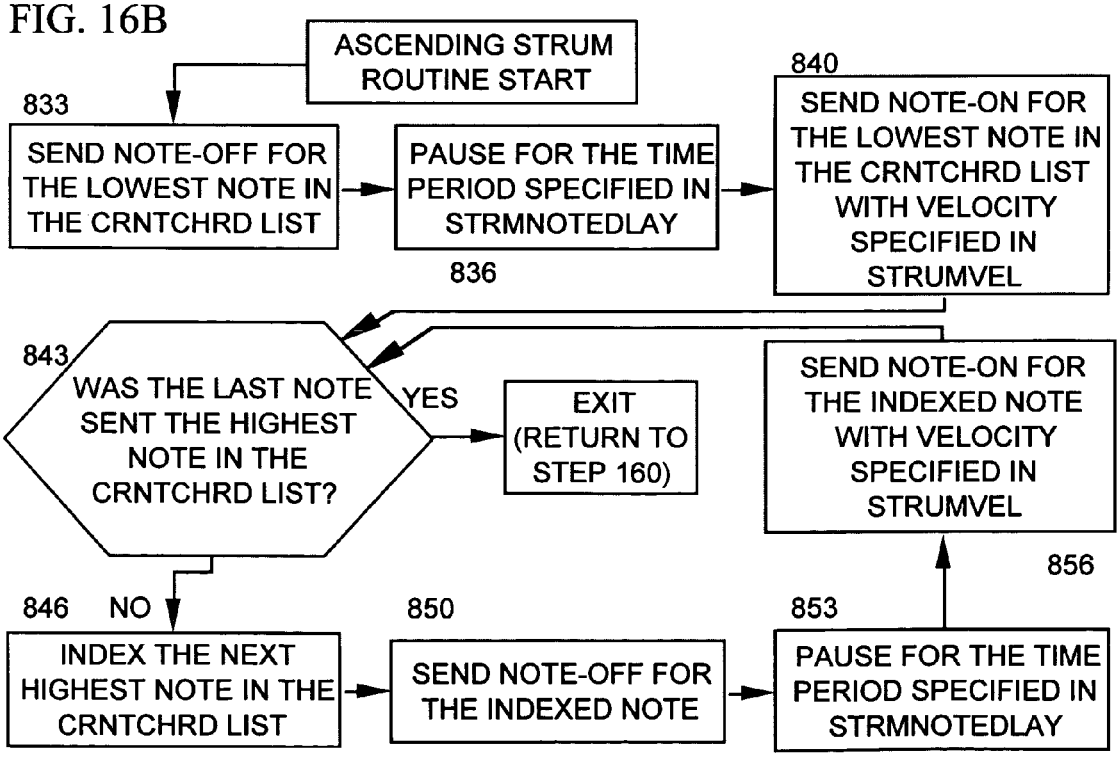
FIG. 16B shows the Ascending Strum Routine.

Referring to FIG. 16B, a note-off command (e.g., a midi note-off command) may be transmitted to the tone-generating device in step 833 for the lowest-pitched note in the CRNTCHRD list. This last position in the CRNTCHRD list may be indexed in a "scratchpad" data memory register. In step 836, the data-processing system may wait for a period of time equal to the value in STRMNOTEDLAY multiplied by 0.5 milliseconds to place a pause between successive notes within a strum. In step 840 a note-on command may be sent for the note which was muted in step 833. In step 843 it may be determined whether the note transmitted in step 840 or 856 was the highest-pitched note in the CRNTCHRD list. If not, the value in the scratchpad may be decremented to index the next highest note in step 846. In step 850, a note-off command may be sent for this newly-indexed note. In step 853 a pause may be inserted as in step 836. Then, in step 856, a note-on command may be sent for the note which was muted in step 850. When it is determined in step 843 that all notes of the chord have been sounded, the strum is finished and the routine may be exited.

Figure 17A:
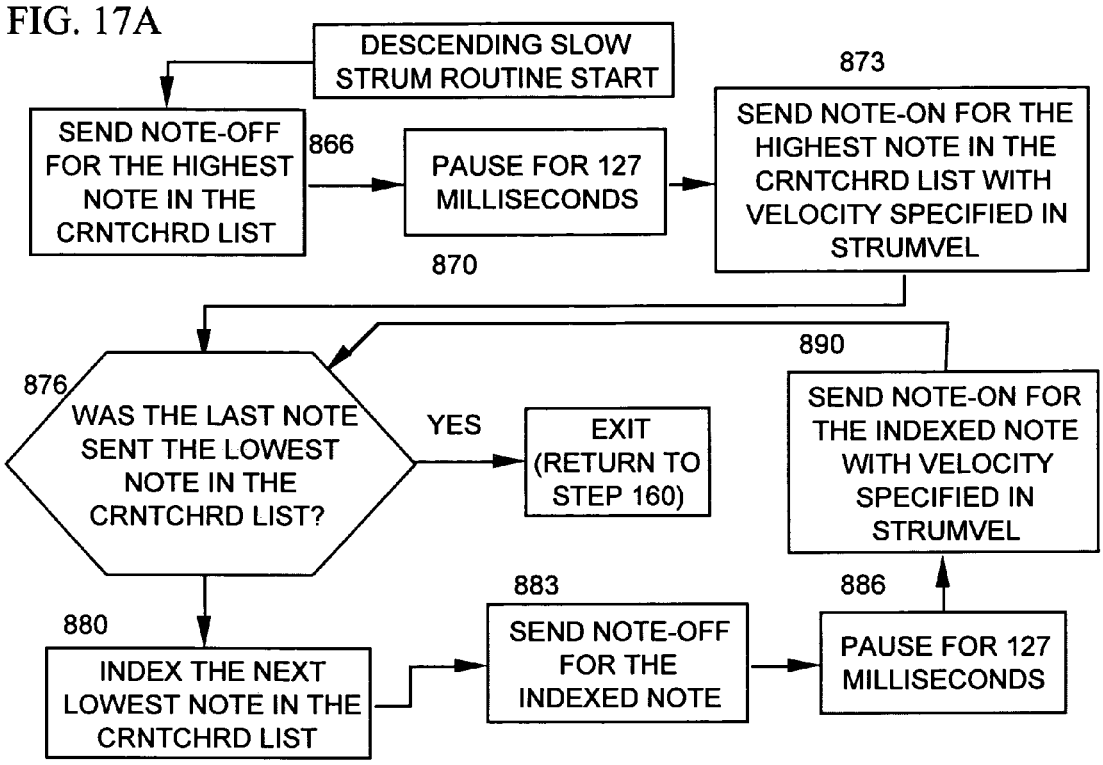
FIG. 17A shows the Descending Slow Strum Routine.

Referring to FIG. 17A, a note-off command (e.g., a midi note-off command) may be transmitted to the tone-generating device in step 866 for the highest-pitched note in the CRNTCHRD list. This first position in the CRNTCHRD list may be indexed in a "scratchpad" data memory register. In step 870, the data-processing system may wait for a predetermined period of 127 milliseconds to place a pause between successive notes within a slow strum. In step 873 a note-on command may be sent for the note which was muted in step 866. The purpose of the pause in step 870 (as well as those in steps 886, 903, and 920) is to (1) set the time delay between successive notes within the chord and to (2) provide increased temporal definition to the audio experience of the initial note-on attack. Without this pause between soundings of the same note, a listener will be more likely to experience an uninterrupted tone. When a pick strums a guitar string, it first mutes the string before plucking it. The software pause approximates this muting effect.

In step 876 it may be determined whether the note transmitted in step 873 or 890 was the lowest-pitched note in the CRNTCHRD list. If not, the value in the scratchpad may be incremented to index the next lowest note in step 880. In step 883, a note-off command may be sent for this newly-indexed note. In step 886 a pause may be inserted as in step 870. Then, in step 890, a note-on command may be sent for the note which was muted in step 883. When it is determined in step 876 that all notes of the chord have been sounded, the strum is finished and the routine may be exited.

Figure 17B:
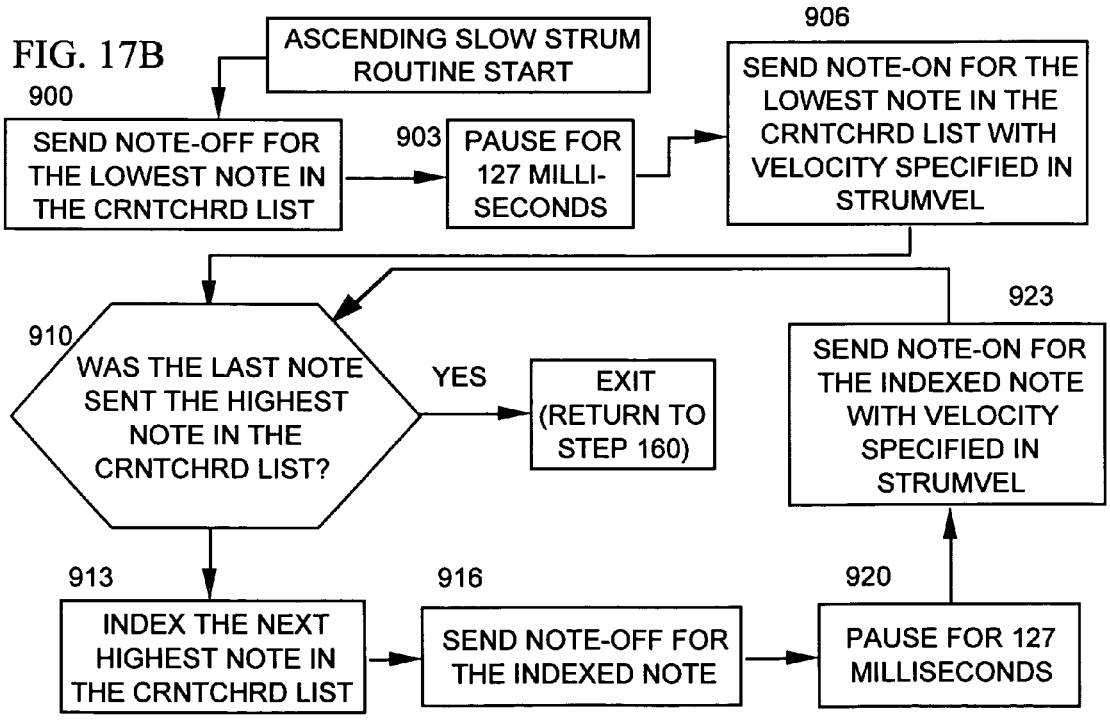
FIG. 17B shows the Ascending Slow Strum Routine.

Referring to FIG. 17B, a note-off command (e.g., a midi note-off command) may be transmitted to the tone-generating device in step 900 for the lowest-pitched note in the CRNTCHRD list. This last position in the CRNTCHRD list may be indexed in a "scratchpad" data memory register. In step 903, the data-processing system may wait for a predetermined period of 127 milliseconds to place a pause between successive notes within a slow strum. In step 906 a note-on command may be sent for the note which was muted in step 900. In step 910 it may be determined whether the note transmitted in step 906 or 923 was the highest-pitched note in the CRNTCHRD list. If not, the value in the scratchpad may be decremented to index the next highest note in step 913. In step 916, a note-off command may be sent for this newly-indexed note. In step 920 a pause may be inserted as in step 903. Then, in step 923, a note-on command may be sent for the note which was muted in step 916. When it is determined in step 910 that all notes of the chord have been sounded, the strum is finished and the routine may be exited.

Figure 18:
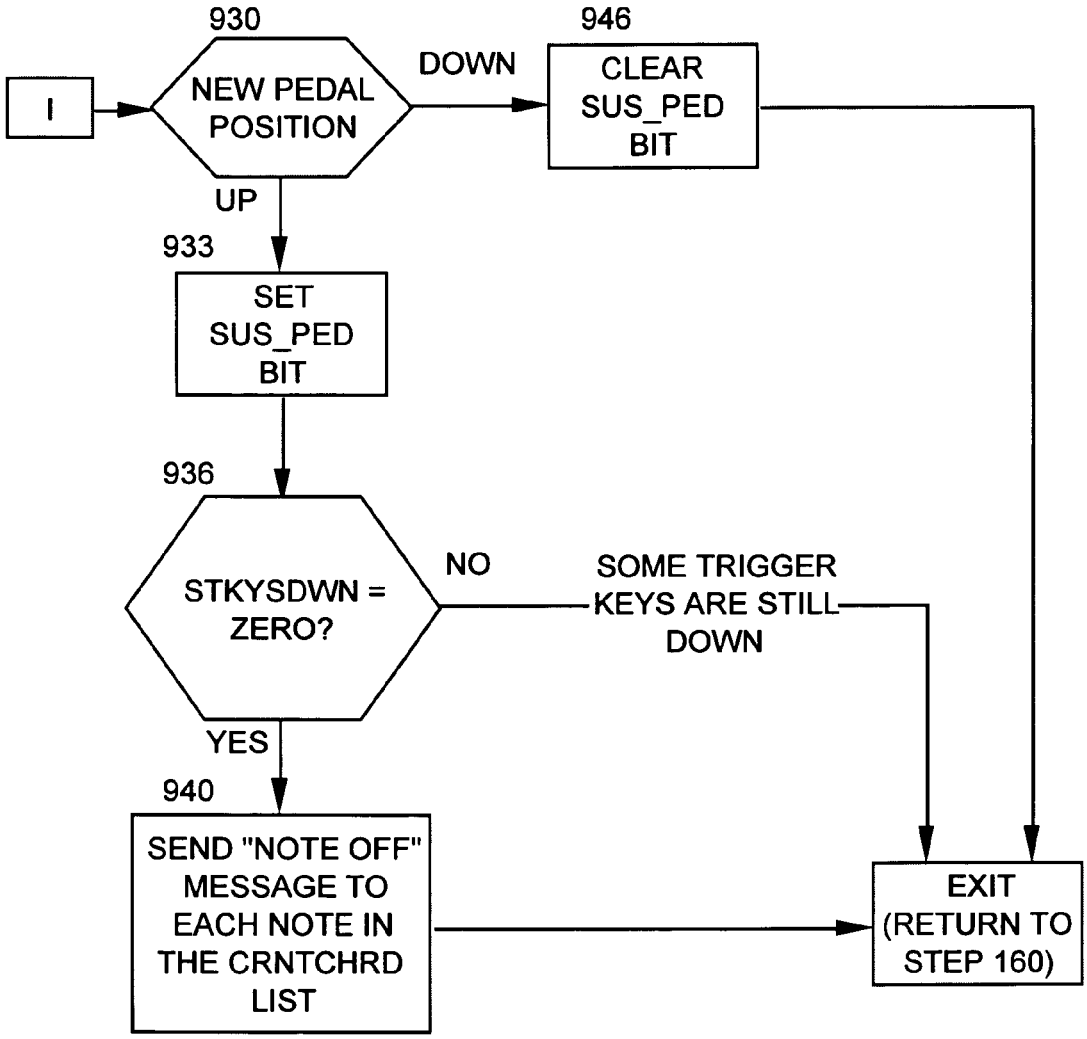
FIG. 18 shows the Sustain Pedal Routine.

Referring to FIG. 18, the new sustain pedal position may be determined in step 930. If the new position is up, then the SUS_PED bit may be set in step 933. It may then be determined in step 936 whether all the strum-trigger keys are up. If so, a note-off message may be transmitted to each note in the CRNTCHRD list in step 940. If the new sustain pedal position is down, then the SUS_PED bit may be cleared in step 946.

ADDITIONAL FEATURES/VARIATIONS/EMBODIMENTS

Two additional strum-trigger modes may be implemented. These modes are variations of Modes 3 & 6 in which the velocity of individual notes is determined by strum-trigger key velocity; and the strum rate is determined by root-select key aftertouch pressure. Various steps in the flow charts provided can be interchanged to produce charts for these two additional strum-trigger modes.

For the Paired Trigger Keys Modes, the arpeggiation direction of the white and black keys may be reversed so that ascending chords are triggered with the index finger and descending chords are triggered with the thumb.

In another variation on the key mapping shown in FIG. 19, the keyboard's treblemost key (C) and the B key 13 keys below may each be assigned to the slow-strum function with the twelve keys in between assigned to the root-select function to be pressed by the right hand. The remaining keys to the left may be strum-trigger keys to be pressed by the left hand. In this mapping it is recommended that the D, E, G, A, and B keys within the strum-trigger area be chord strum-trigger keys and that the remaining C and F keys serve as muted string strum triggers. This way, the index finger and thumb of the left hand can comfortably play chords of alternating direction. And with this alternate embodiment, as stated above, the DES keys may be black and the ASC keys may be white, or vice versa.

To assist the user in using the invention, it is recommended that a heavy paper or plastic strip be provided which can be fastened to the keyboard case on the rail immediately behind the keys. The various chord types as well as the slow-strum keys may be printed on the strip. Thus, the user will easily be able to find the trigger keys for whichever chord he/she wishes to play at any moment. Two different strips may be provided: one for Modes 1-3 and another for Modes 4-6. Alternately, chord types may be printed directly onto the keyboard frame or top panel.

The invention may be used in a Janko keyboard w/independent keys, as described in U.S. Pat. No. 5,726,374.

The invention may be realized in a patch which assigns some keys as conventional note-sounding keys; i.e., the keyboard may be configured so that some keys are used for the present invention while other keys are simultaneously assigned to other functions.

Instead of using keys on the keyboard to select root notes, a conventional midi bass foot-pedals unit, e.g., the Roland PK-7, may be used with a midi-in jack on the keyboard. Bass keys on the keyboard may then be used to play basslines or other musical parts. Alternately, foot-pedals may be used as strum-trigger keys or for both root-select and strum-trigger keys. In this latter configuration, one foot presses root-select keys (pedals) and the other foot presses strum-trigger keys (pedals), thus freeing up both hands to play other musical parts. By using foot-pedals for both root-select and strum-trigger keys, the musician may then use his/her hands to play a keyboard, lead guitar, saxophone, or other instrument.

Since the chords provided with the keyboard (e.g., the map shown in FIG. 19) may not suit an individual user, software may be included which provides means for the user to custom-define chords and chord maps.

Other features may be added to the unit; such as a floppy disk drive, control panel LEDs, pitch/mod wheels, etc.

In Modes 2 & 5, the software may allow the user to select from several maximum timer limits in addition to the 796 millisecond limit shown in steps 416 & 660. A 1000 millisecond limit can be selected in case a musician likes to play slow tempos, and a 600 millisecond limit can be selected for fast tempos. These modifications can be accomplished by changing the period value for TIMER and leaving the maximum TIMER value unchanged at 35. For example, to decrease the limit to 600 milliseconds, the timer period may be decreased from 22.72 milliseconds to 17.14 Ms. Also, since some guitarists tend to strum with vertically wide arm movements and others with small movements of the wrist only, different guitarists will naturally produce strums with different elapsed times from first note to last, even when playing the same pattern at the same tempo. Thus, the software should allow the user to globally adjust the strum rate. This adjustment can be accomplished by changing the 0.5 millisecond function value in steps 803, 820, 836, & 853 (see FIG. 16). For example, to reproduce the playing style of a guitarist who prefers to strum the strings quickly, the 0.5 Ms function value should be decreased (e.g., to 0.4 Ms). Such a decrease would produce strums with a more precise percussive quality (since the individual note attacks would occur closer in time to each other). This decrease would also have the effect of making upstrums and downstrums sound more alike.

The invention may be realized in a keyboard in which other guitar-emulation modes (e.g., those described in U.S. Pat. No. 5,726,374) are also available to the user via control-panel switches.

The sequence of key-type identification inquiries shown in FIG. 2 as steps 190-220 may be replaced with a faster method in which a data memory location is assigned to each key. When a patch is loaded, a vector may be written into this data memory location. This vector may point to a program memory location which corresponds with the software subroutine currently assigned to the key. When a key event occurs, the vector may be used to call the key-type subroutine immediately.

The invention may be modified in many additional ways which will be obvious to those of ordinary skill in the art. The scope of the invention is thus in no way to be considered limited by the preferred embodiment and variations described above; but rather, by the allowed claims and their full scope of equivalents.

The invention claimed is:

1. An electronic musical instrument comprising, at least 14 keys, each of which a user may alternate between a rest key state and a pressed key state, a data processing system, and a tone-generating device, wherein, said data processing system receives key state information from said keys, processes said key state information into musical event information according to a software program and transmits said musical event information to said tone-generating device, said software program divides said keys into at least two groups, said two groups consisting of a group of at least twelve root-select keys, and a group of at least two strum-trigger keys, said twelve root-select keys each correspond with a different note of the twelve standard notes contained within an octave, said two strum-trigger keys each correspond with a different chord type, said data processing system transmits musical event information representing a group of notes in response to a rest-to-pressed state change of a strum-trigger key, said group of notes comprises a musical chord based, at least in part, on:

(a) the root note corresponding with a root-select key which has been pressed and thereby selected, and (b) the chord type corresponding with the pressed strum-trigger key, if a first root-select key is held in pressed state as a second root-select key is pressed, said selected root-select key is said second root-select key, and if either of the two pressed root-select keys are released as the other remains pressed, then said selected root-select key is the remaining pressed key.

2. An electronic musical instrument comprising, at least 14 keys, each of which a user may alternate between a rest key state and a pressed key state, a data processing system, and a tone-generating device, wherein, said data processing system receives key state information from said keys, processes said key state information into musical event information according to a software program and transmits said musical event information to said tone-generating device, said software program divides said keys into at least two groups, said two groups consisting of a group of at least twelve root-select keys, and a group of at least two strum-trigger keys, said twelve root-select keys each correspond with a different note of the twelve standard notes contained within an octave, said two strum-trigger keys each correspond with a different chord type, said data processing system transmits musical event information representing a group of notes in response to a rest-to-pressed state change of a strum-trigger key, said group of notes comprises a musical chord based, at least in part, on:

(a) the root note corresponding with a root-select key which has been pressed and thereby selected, and (b) the chord type corresponding with the pressed strum-trigger key, said group of notes are transmitted in an ascending sequence, said data processing system performs a second transmission of musical event information as a result of a pressed-to-rest state change of a strum-trigger key, and said second transmission of musical event information represents a group of notes transmitted in a descending sequence.

3. An electronic musical instrument as in claim 2 wherein, said transmissions are contingent upon at least one root-select key being held in pressed state as either of said strum-trigger key state changes occur.

4. An electronic musical instrument as in claim 3 wherein, said data processing system transmits note-muting musical event information as a result of a pressed-to-rest state change of said at least one root-select key.

5. An electronic musical instrument comprising, at least 16 keys, each of which a user may alternate between a rest key state and a pressed key state, a data processing system, and a tone-generating device, wherein, said data processing system receives key state information from said keys, processes said key state information into musical event information according to a software program and transmits said musical event information to said tone-generating device, said software program divides said keys into at least two groups, said two groups consisting of a group of at least twelve root-select keys, and a group of at least two pairs of strum-trigger keys, each of said pairs corresponding with a different chord type and consisting of an ASC key and a DES key, said twelve root-select keys each correspond with a different note of the twelve standard notes contained within an octave, said data processing system transmits musical event information representing a group of notes in response to a rest-to-pressed state change of a strum-trigger key, said group of notes comprises a musical chord based, at least in part, on:

(a) the root note corresponding with a root-select key which has been pressed and thereby selected, and (b) the chord type corresponding with the pressed strum-trigger key, said data processing system transmits musical event information representing an ascending group of notes as a result of a rest-to-pressed state change of an ASC key, and said data processing system transmits musical event information representing a descending group of notes as a result of a rest-to-pressed state change of a DES key.

6. An electronic musical instrument as in claim 5 wherein, the two chord types which the two strum-trigger key pairs correspond with are major and minor, respectively.

7. An electronic musical instrument as in claim 5 wherein, said four strum-trigger keys are included in a keyboard, said keyboard includes at least two key rows, and the two keys within at least one of said strum-trigger key pairs occupy different key rows.

8. An electronic musical instrument as in claim 7 wherein, substantially all the ASC keys are grouped in one of said key rows and, substantially all the DES keys are grouped in another of said key rows.

9. An electronic musical instrument as in claim 8 further comprising, at least ten strum-trigger keys grouped into five key pairs wherein, said keyboard is a substantially conventional musical keyboard, one of said key pairs consists of a C key and a C# key, one of said key pairs consists of a D key and a D# key, one of said key pairs consists of an F key and an F# key, one of said key pairs consists of a G key and a G# key, and one of said key pairs consists of an A key and an A# key.

10. An electronic musical instrument as in claim 9 wherein, said C, D, F, G, and A keys are ASC keys, and said C#, D#, F#, G#, and A# keys are DES keys.

11. An electronic musical instrument as in claim 9, wherein said C, D, F, G, and A keys are DES keys, and said C#, D#, F#, G#, and A# keys are ASC keys.

12. An electronic musical instrument as in claim 8 comprising, at least ten strum-trigger keys grouped into five key pairs wherein, said keyboard is a substantially conventional musical keyboard, one of said key pairs consists of a C# key and a D key, one of said key pairs consists of a D# key and an E key, one of said key pairs consists of an F# key and a G key, one of said key pairs consists of a G# key and an A key, and one of said key pairs consists of an A# key and a B key.

13. An electronic musical instrument as in claim 12 wherein, said D, E, G, A, and B keys are ASC keys, and said C#, D#, F#, G# and A# keys are DES keys.

14. An electronic musical instrument as in claim 12 wherein, said D, E, G, A, and B keys are DES keys, and said C#, D#, F#, G#, and A# keys are ASC keys.

15. An electronic musical instrument comprising, at least 14 keys, each of which a user may alternate between a rest key state and a pressed key state, a data processing system, and a tone-generating device, wherein, said data processing system receives key state information from said keys, processes said key state information into musical event information according to a software program and transmits said musical event information to said tone-generating device, said software program divides said keys into at least two groups, said two groups consisting of a group of at least twelve root-select keys, and a group of at least two strum-trigger keys, said twelve root-select keys each correspond with a different note of the twelve standard notes contained within an octave, said two strum-trigger keys each correspond with a different chord type, said data processing system transmits musical event information representing a group of notes in response to a rest-to-pressed state change of a strum-trigger key, said group of notes comprises a musical chord based, at least in part, on:

(a) the root note corresponding with a root-select key which has been pressed and thereby selected, and (b) the chord type corresponding with the pressed strum-trigger key, said strum-trigger keys are included in a keyboard, said musical event information includes a loudness value, said keyboard measures a velocity with which strum-trigger keys are toggled between rest and pressed state and transmits this velocity data to said data processing system, and said loudness value is proportional to said velocity data, whereby, faster strum-trigger keystrokes trigger louder musical tones.

16. An electronic musical instrument comprising, at least 14 keys, each of which a user may alternate between a rest key state and a pressed key state, a data processing system, and a tone-generating device, wherein, said data processing system receives key state information from said keys, processes said key state information into musical event information according to a software program and transmits said musical event information to said tone-generating device, said software program divides said keys into at least two groups, said two groups consisting of a group of at least twelve root-select keys, and a group of at least two strum-trigger keys, said twelve root-select keys each correspond with a different note of the twelve standard notes contained within an octave, said two strum-trigger keys each correspond with a different chord type, said data processing system transmits musical event information representing a group of notes in response to a rest-to-pressed state change of a strum-trigger key, said group of notes comprises a musical chord based, at least in part, on:

(a) the root note corresponding with a root-select key which has been pressed aid thereby selected, and (b) the chord type corresponding with the pressed strum-trigger key, said data processing system:

(a) transmits said group of notes in a sequence with a delay period between successive notes, (b) measures an elapsed time between successive strum-trigger key state changes, and (c) employs a predetermined algorithm which proportionally modulates said delay period according to said elapsed time, whereby, a shorter elapsed time between successive strum-trigger keystrokes will result in a shorter delay period between successive notes.

17. An electronic musical instrument comprising, at least 14 keys, each of which a user may alternate between a rest key state and a pressed key state, a data processing system, and a tone-generating device, wherein, data processing system receives key state information from said keys, processes said key state information into musical event information according to a software program and transmits said musical event information to said tone-generating device, said software program divides said keys into at least two groups, said two groups consisting of a group of at least twelve root-select keys, and a group of at least two strum-trigger keys, said twelve root-select keys each correspond with a different note of the twelve standard notes contained within an octave, said two strum-trigger keys each correspond with a different chord type, said data processing system transmits musical event information representing a group of notes in response to a rest-to-pressed state change of a strum-trigger key, said group of notes comprises a musical chord based, at least in part, on:

(a) the root note corresponding with a root-select key which has been pressed and thereby selected, and (b) the chord type corresponding with the pressed strum-trigger key, said root-select keys are included in a keyboard, said musical event information includes a loudness value, said keyboard measures the pressure with which root-select keys are held in pressed state and transmits this aftertouch pressure data to said data processing system, and said loudness value is proportional to said aftertouch pressure data, whereby, strum-trigger keystrokes trigger louder musical tones when root-select keys are held and pressed with more downward force.

18. An electronic musical instrument comprising, at least 14 keys, each of which a user may alternate between a rest key state and a pressed key state, a data processing system, and a tone-generating device, wherein, said data processing system receives key state information from said keys, processes said key state information into musical event information according to a software program and transmits said musical event information to said tone-generating device, said software program divides said keys into at least two groups, said two groups consisting of a group of at least twelve root-select keys, and a group of at least two strum-trigger keys, said twelve root-select keys each correspond with a different note of the twelve standard notes contained within an octave, said two strum-trigger keys each correspond with a different chord type, said data processing system transmits musical event information representing a group of notes in response to a rest-to-pressed state change of a strum-trigger key, said group of notes comprises a musical chord based, at least in part, on:

(a) the root note corresponding with a root-select key which has been pressed and thereby selected, and (b) the chord type corresponding with the pressed strum-trigger key, said strum-trigger keys are included in a keyboard, said keyboard measures a velocity with which strum-trigger keys are toggled between rest and pressed state and transmits this velocity data to said data processing system, said data processing system:

(a) transmits said group of notes in a sequence with a delay period between successive notes, and (b) employs a predetermined algorithm which inversely modulates said delay period according said velocity, whereby, faster strum-trigger key strokes will result in a shorter delay period between successive notes.

19. A method of playing a musical chord, said musical chord comprising a group of notes, the method comprising:

assigning at least twelve keys to a root-select function, interpreting each of said twelve root-select keys as corresponding with a different note of the twelve standard notes contained within an octave, receiving a signal from one of said root-select keys, said signal indicating that the key has been pressed by a user, assigning at least two additional keys to a strum-trigger function, interpreting each of said two strum-trigger keys as corresponding with a different musical chord type, receiving a first signal from one of said strum-trigger keys, said first signal indicating that the key has been pressed by a user, transmitting musical event information representing said group of notes in an ascending sequence to a tone-generating device in response to said first strum-trigger key signal, receiving a second signal from said strum-trigger key, said second signal indicating that the key has been released by the user, and transmitting musical event information representing said group of notes in a descending sequence in response to said second signal wherein, said musical chord is based, at least in part, on:

(a) the root note corresponding with the pressed root-select key, and (b) the chord type corresponding with the pressed strum-trigger key.

20. A method of playing a chord as in claim 19 further comprising:

making said transmissions contingent upon at least one root-select key being held in pressed state as either of said strum-trigger key state changes occur.

21. A method of playing a chord as in claim 20 further comprising:

receiving a second signal from said root-select key, said second root-select key signal indicating that the key has been released by the user, and transmitting note-muting musical event information in response to said second root-select key signal.

22. A method of playing a musical chord comprising:

assigning at least twelve keys to a root-select function, interpreting each of said twelve root-select keys as corresponding with a different note of the twelve standard notes contained within an octave, receiving a signal from one of said root-select keys, said signal indicating that the key has been pressed by a user, assigning at least four additional keys to a strum-trigger function, grouping said at least four strum-trigger keys into two pairs, interpreting each of said pairs to correspond with a different chord type and to consist of an ASC key and a DES key, transmitting musical event information representing a musical chord comprising an ascending group of notes in response to a key-press signal received from an ASC key, and transmitting musical event information representing a musical chord comprising a descending group of notes in response to a key-press signal received from a DES key, wherein, each of said musical chords is based, at least in part, on:

(a) the root note corresponding with the pressed root-select key, and (b) the chord type corresponding with the pressed strum-trigger key.

23. A method of playing a chord as in claim 22 wherein, the two chord types which the two strum-trigger key pairs correspond with are major and minor, respectively.

24. A method of playing a chord as in claim 22 wherein, said four strum-trigger keys are included in a keyboard, said keyboard includes at last two key rows, and the two keys within at least one of said strum-trigger key pairs occupy different key rows.

25. A method of playing a chord as in claim 24 wherein, substantially all the ASC keys are grouped in one of said key rows and, substantially all the DES keys are grouped in another of said key rows.

26. A method of playing a chord as in claim 25 further comprising, assigning at least ten keys to a strum-trigger function, said ten keys being in addition to said twelve root-select keys, grouping said at least ten strum-trigger keys into five pairs, wherein, said keyboard is a substantially conventional musical keyboard, one of said key pairs consists of a C key and a C# key, one of said key pairs consists of a D key and a D# key, one of said key pairs consists of an F key and an F# key, one of said key pairs consists of a G key and a G# key, and one of said key pairs consists of an A key and an A# key.

27. A method of playing a chord as in claim 26 wherein, said C, D, F, G, and A keys are ASC keys, and said C#, D#, F#, G#, and A# keys are DES keys.

28. A method of playing a chord as in claim 26 wherein,
said C, D, F, G, and A keys are DES keys, and
said C#, F#, G#, and A# keys are ASC keys.

29. A method of playing a chord as in claim 25 further comprising,
assigning at least ten keys to a strum-trigger function,
said ten keys being in addition to said twelve root-select keys,
grouping said at least ten strum-trigger keys into five pairs, wherein,
said keyboard is a substantially conventional musical keyboard,
one of said key pairs consists of a C# key and a D key,
one of said key pairs consists of a D# key and an E key,
one of said key pairs consists of an F# key and a G key,
one of said key pairs consists of a G# key and an A key, and
one of said key pairs consists of an A# key and a B key.

30. A method of playing a chord as in claim 29 wherein,
said D, E, G, A, and B keys are ASC keys, and
said C#, D#, F#, G# and A# keys are DES keys.

31. A method of playing a chord as in claim 29 wherein,
said D, E, G, A, and B keys are DES keys, and
said C#, D#, F#, C#, and A# keys are ASC keys.

32. A method of playing a musical chord comprising:
assigning at least twelve keys to a root-select function,
interpreting each of said twelve root-select keys as corresponding with a different note of the twelve standard notes contained within an octave,
receiving signal from one of said root-select keys, said signal indicating that the key has been pressed by a user,
assigning at least two additional keys to a strum-trigger function,
interpreting each of said two strum-trigger keys as corresponding with a different musical chord type,
receiving a signal from one of said strum-trigger keys, said signal indicating that the key has been pressed by a user, and
transmitting musical event information representing a musical chord to a tone-generating device in response to said strum-trigger key signal, wherein,
said musical chord is based, at least in part, on:
(a) the root note corresponding with the pressed root-select key, and
(b) the chord type corresponding with the pressed strum-trigger key,
said strum-trigger key signal includes data representing a velocity with which the strum-trigger key was pressed by the user,
said musical event information includes a loudness value, and
said loudness value is proportional to said velocity data whereby,
faster strum-trigger keystrokes trigger louder musical tones.

33. A method of playing a musical chord, said musical chord comprising a group of notes, the method comprising:
assigning at least twelve keys to a root-select function,
interpreting each of said twelve root-select keys as corresponding with a different note of the twelve standard notes contained within an octave,
receiving a signal from one of said root-select keys, said signal indicating that the key has been pressed by a user,
assigning at least two additional keys to a strum-trigger function,
interpreting each of said two strum-trigger keys as corresponding with a different musical chord type,
receiving a signal from one of said strum-trigger keys, said signal indicating that the key has been pressed by a user, and
transmitting musical event information representing said group of notes in a sequence with a delay period between successive notes to a tone-generating device in response to said strum-trigger key signal,
measuring an elapsed time between successive strum-trigger key state changes, and
employing a predetermined algorithm which proportionally modulates said delay period according to said elapsed time, wherein,
said musical chord is based, at least in part, on:
(a) the root note corresponding with the pressed root-select key, and
(b) the chord type corresponding with the pressed strum-trigger key, whereby,
a shorter elapsed time between successive strum-trigger keystrokes will result in a shorter delay period between successive notes.

34. A method of playing a musical chord comprising:
assigning at least twelve keys to a root-select function
interpreting each of said twelve root-select keys as corresponding with a different note of the twelve standard notes contained within an octave,
receiving a signal from one of said root-select keys, said signal indicating that the key has been pressed by a user,
receiving aftertouch pressure data from said root-select key,
assigning at least two additional keys to a strum-trigger function,
interpreting each of said two strum-trigger keys as corresponding with a different musical chord type,
receiving a signal from one of said strum-trigger keys, said signal indicating that the key has been pressed by a user,
transmitting musical event information representing a musical chord to a tone-generating device in response to said strum-trigger key signal,
including a loudness value with said musical event information, and
making said loudness value proportional to said aftertouch pressure data wherein,
said musical chord is based, at least in part, on:
(a) the root note corresponding with the pressed root-select key, and
(b) the chord type corresponding with the pressed strum-trigger key, whereby,
strum-trigger keystrokes trigger louder musical tones when root-select keys are held and pressed with more downward force.

35. A method of playing a musical chord, said musical chord comprising a group of notes, the method comprising:
assigning at least twelve keys to a root-select function,
interpreting each of said twelve root-select keys as corresponding with a different note of the twelve standard notes contained within an octave,
receiving a signal from one of said root-select keys, said signal indicating that the key has been pressed by a user,
assigning at least two additional keys to a strum-trigger function,
interpreting each of said two strum-trigger keys as corresponding with a different musical chord type, receiving a signal from one of said strum-trigger keys, said signal indicating that the key has been pressed by a user and including data representing a velocity with which the strum-trigger key was pressed by the user, transmitting musical event information representing said group of notes in a sequence with a delay period between successive notes to a tone-generating device in response to said strum-trigger key signal, and employing a predetermined algorithm which inversely modulates said delay period according said velocity data, wherein, said musical chord is based, at least in part, on:

(a) the root note corresponding with the pressed root-select key, and (b) the chord type corresponding with the pressed strum-trigger key, whereby, faster strum-trigger keystrokes will result in a shorter delay period between successive notes.

* * * * *